US007978158B2

(12) United States Patent
Fukumoto et al.

(10) Patent No.: US 7,978,158 B2
(45) **Date of Patent: *Jul. 12, 2011**

(54) DISPLAY DEVICE AND DRIVING METHOD THEREOF

(75) Inventors: Ryota Fukumoto, Kanagawa (JP); Hajime Kimura, Kanagawa (JP); Mitsuaki Osame, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/887,985

(22) Filed: Sep. 22, 2010

(65) Prior Publication Data

US 2011/0012939 A1 Jan. 20, 2011

Related U.S. Application Data

(63) Continuation of application No. 11/287,492, filed on Nov. 28, 2005, now Pat. No. 7,812,794.

(30) Foreign Application Priority Data

Dec. 6, 2004 (JP) ..... 2004-353444

(51) Int. Cl.
*G09G 3/30* (2006.01)

(52) U.S. Cl. ..... 345/76; 345/82; 315/169.3

(58) Field of Classification Search ..... 345/76, 345/82, 204; 315/169.3; 250/208.1; 257/59, 257/72, 88; 313/500, 598; 349/69
See application file for complete search history.

(56) References Cited

U.S. PATENT DOCUMENTS

| | | | |
|---|---|---|---|
| 5,594,463 | A | 1/1997 | Sakamoto |
| 5,849,601 | A | 12/1998 | Yamazaki |
| 6,335,713 | B1 | 1/2002 | Imai |
| 6,376,994 | B1 | 4/2002 | Ochi et al. |

(Continued)

FOREIGN PATENT DOCUMENTS

CN 1318818 A 10/2001

(Continued)

OTHER PUBLICATIONS

Office Action (Chinese Application No. 200510129546.8) mailed Mar. 7, 2008 with full English translation, 67 pages.

(Continued)

*Primary Examiner* — Abbas Abdulselam
(74) *Attorney, Agent, or Firm* — Fish & Richardson P.C.

(57) ABSTRACT

In the case where variations of environmental temperature or variations with time occur depending on characteristics of a light-emitting element, variations are generated in luminance. In the invention, a display device for suppressing effects due to variations of a current value of a light-emitting element, which is caused by variations of environmental temperature and variations with time.

A first substrate having a pixel portion in which pixels constituted by a plurality of transistors are arranged in matrix has a source driver for supplying a video signal, a gate driver for selecting a pixel, a power source circuit, and a compensation circuit for compensating variations in characteristics of a light-emitting element. The first substrate is connected to a second substrate through a connecting wire, and the second substrate has a controller and a video memory. The controller is a piece for making a signal which is necessary for a display device to display from image data to be inputted externally such as a CPU by using a video memory as required.

6 Claims, 30 Drawing Sheets

U.S. PATENT DOCUMENTS

| | | | | |
|---|---|---|---|---|
| 6,417,824 | B1 | 7/2002 | Tokunaga et al. | |
| 6,518,962 | B2 | 2/2003 | Kimura et al. | |
| 6,528,951 | B2 | 3/2003 | Yamazaki et al. | |
| 6,552,736 | B2 | 4/2003 | Honda et al. | |
| 6,633,134 | B1 | 10/2003 | Kondo et al. | |
| 6,873,275 | B2 | 3/2005 | Komamura et al. | |
| 7,221,338 | B2 | 5/2007 | Yamazaki et al. | |
| 7,248,235 | B2 | 7/2007 | Fujii et al. | |
| 7,352,133 | B2 | 4/2008 | Osame et al. | |
| 7,812,794 | B2 * | 10/2010 | Fukumoto et al. | 345/76 |
| 2001/0030511 | A1 | 10/2001 | Yamazaki et al. | |
| 2003/0132716 | A1 | 7/2003 | Yamazaki et al. | |
| 2003/0209989 | A1 | 11/2003 | Anzai et al. | |
| 2005/0012731 | A1 | 1/2005 | Yamazaki et al. | |
| 2005/0017963 | A1 | 1/2005 | Yamazaki et al. | |
| 2005/0017964 | A1 | 1/2005 | Yamazaki et al. | |
| 2005/0225250 | A1 | 10/2005 | Anzai et al. | |

FOREIGN PATENT DOCUMENTS

| | | | |
|---|---|---|---|
| CN | 1480918 | A | 3/2004 |
| CN | 2631184 | Y | 8/2004 |
| EP | 1148466 | A2 | 10/2001 |
| EP | 1406234 | A2 | 4/2004 |
| JP | 11-272223 | A | 10/1999 |
| JP | 2003-323159 | A | 11/2003 |

OTHER PUBLICATIONS

Tomoyuki Iwabuchi et al.; "Development of a 1.51-in. Quarter-XGA (Monochrome 423ppi) Fully Integrated AMOLED Display and a Proposal of its Applications"; SID '05 Digest; pp. 265-267; May 24, 2005.

Hiroyuki Miyake et al.; "A Voltage Driving AMOLED Display with Luminance Control"; SID '05 Digest; pp. 240-243; May 24, 2005.

* cited by examiner (A)

(B)

(A)

(B)

DISPLAY DEVICE AND DRIVING METHOD THEREOF

CROSS-REFERENCE TO RELATED APPLICATIONS

This application is a continuation of U.S. application Ser. No. 11/287,492, filed Nov. 28, 2005, now allowed, which claims the benefit of a foreign priority application filed in Japan as Serial No. 2004-353444 on Dec. 6, 2004, both of which are incorporated by reference.

TECHNICAL FIELD

The present invention relates to a display device provided with a correcting function, and a driving method thereof.

BACKGROUND ART

In recent years, a display device including a light-emitting element typified by an EL (Electro Luminescence) element has been developed, and wide utilization is expected by making use of advantages of a self-luminous type such as high image quality, a wide viewing angle, flatness, and lightweight. Since a light-emitting element has characteristics that its luminance is proportional to a current value, there is a display device employing constant current driving by which a constant current flows to the light-emitting element in order to express a gray scale accurately (see Patent Document 1).

[Patent Document 1] Japanese Patent Publication No. 2003-323159

DISCLOSURE OF THE INVENTION

Problems to be Solved by the Invention

A light-emitting element has characteristics in which its resistance value (internal resistance value) changes in accordance with a peripheral temperature (hereinafter referred to as an environmental temperature). Specifically, when room temperature is normal temperature, a resistance value is decreased if the temperature is higher than the normal temperature, and a resistance value is increased if the temperature is lower than the normal temperature. Therefore, if the temperature rises, a current value is increased so that luminance is higher than the desired luminance, and if temperature falls, a current value is decreased so that luminance is lower than the desired luminance. Such characteristics of a light-emitting element are shown in a graph of a relation between voltage-current characteristics of a light-emitting element and temperature (see FIG. 10A). In addition, a light-emitting element has characteristics in which the current value is decreased with time. Such characteristics of a light-emitting element are shown in a graph of a relation between voltage-current characteristics of a light-emitting element and time (see FIG. 10B).

If environmental temperature changes or variations with time are occurred by the abovementioned characteristics of a light-emitting element, luminance varies. In view of the abovementioned actual condition, it is an object of the invention to provide a display device for suppressing an effect by variations in a current value of a light-emitting element, which is resulted from change of environmental temperature and change with time.

Means for Solving the Problem

A display device of the invention has a pixel region including a plurality of pixels, a source driver, and a gate driver.

Each of the plurality of pixels has a light-emitting element, a first transistor for controlling an input of a video signal to the pixel, a second transistor for controlling light emission or no light emission of the light-emitting element, and a capacitor for holding the video signal.

A display device of the invention has a monitor element, a current source for supplying a current to the monitor element, an operational amplifier, a first transistor for amplifying an output of the operational amplifier, a light-emitting element, and a second transistor for driving the light-emitting element. An output terminal of the operational amplifier is connected to a base of the first transistor, an emitter terminal of a transistor is connected to a positive power source, and a collector terminal of the first transistor is connected to an inverting input terminal of the operational amplifier, thereby a buffer amplifier is constituted. One electrode of each of the monitor element and the light-emitting element is connected to a constant potential power source, and the other electrode of the monitor element is connected to the buffer amplifier. A potential of the other electrode of the monitor element is set to be the same as a potential outputted through an amplifier, and the outputted potential is applied to the other electrode of the light-emitting element through the second transistor.

A display device of the invention has a monitor element, a current source for supplying a current to the monitor element, a capacitor for holding a voltage between opposite electrodes of the monitor element, a first switch for switching between an on state and an off state of a connection between the capacitor and the current source, a second switch for switching between an on state and an off state of a connection between the current source and the monitor element, an operational amplifier, a first transistor for amplifying an output of the operational amplifier, a light-emitting element, and a second transistor for driving the light-emitting element. An output terminal of the operational amplifier is connected to a base of the first transistor, an emitter terminal of a transistor is connected to a positive power source, and a collector terminal of the first transistor is connected to an inverting input terminal of the operational amplifier, thereby a buffer amplifier is constituted. One electrode of the monitor element and the light-emitting element is connected to a constant potential power source. When the first switch and the second switch are in an on state, the other electrode of the monitor element is connected by a buffer amplifier; a potential of the other electrode of the monitor element is set to be the same as a potential outputted through an amplifier; and the outputted potential is applied to the other electrode of the light-emitting element. When the first switch and the second switch are in an off state, the capacitor holds the other potential of the monitor element at the moment when the first switch and the second switch are turned off; the other potential of the monitor element held by the capacitor is applied to the buffer amplifier; the potential of the other electrode of the monitor element is set to be the same as the potential outputted through an amplifier; and the outputted potential is applied to the other electrode of the light-emitting element through the second transistor.

According to a display device of the invention, a first substrate having a pixel portion in which pixels constituted by a plurality of transistors are arranged in matrix has a source driver for supplying a video signal to the pixels, a gate driver for selecting a pixel to which a video signal is supplied, and a compensation circuit for compensating a characteristics change of a light-emitting element; the first substrate is connected to a circuit substrate through a connecting wire; and the circuit substrate has a power source circuit, a controller, and a video memory.

According to a display device of the invention, a first substrate having a pixel portion in which pixels constituted by a plurality of transistors are arranged in matrix has a source driver for supplying a video signal to the pixels, and a gate driver for selecting a pixel to which a video signal is supplied; the first substrate is connected to a circuit substrate through a connecting wire; and the circuit substrate has a power source circuit, a controller, a video memory, and a compensation circuit for compensating a characteristics change of a light-emitting element.

According to a display device of the invention, a first substrate having a pixel portion in which pixels constituted by a plurality of transistors are arranged in matrix has a source driver for supplying a video signal to the pixels, and a gate driver for selecting a pixel to which a video signal is supplied. The first substrate is connected to a circuit substrate through a connecting wire, and has a power source circuit and a compensation circuit for compensating a characteristics change of a light-emitting element over the connecting wire; and the circuit substrate has a controller and a video memory.

According to a display device of the invention, a first substrate having a pixel portion in which pixels constituted by a plurality of transistors are arranged in matrix has a source driver for supplying a video signal to the pixels, a gate driver for selecting a pixel to which a video signal is supplied, and a compensation circuit for compensating a characteristics change of a light-emitting element. The first substrate is connected to a circuit substrate through a connecting wire, and has a power source circuit over the connecting wire; and the circuit substrate has a controller and a video memory.

According to a display device of the invention, a first substrate having a pixel portion in which pixels constituted by a plurality of transistors are arranged in matrix has a source driver for supplying a video signal to the pixels, a gate driver for selecting a pixel to which a video signal is supplied, a power source circuit, and a compensation circuit for compensating a characteristics change of a light-emitting element. The first substrate is connected to a circuit substrate through a connecting wire, and the circuit substrate has a controller and a video memory.

According to a display device of the invention, a first substrate having a pixel portion in which pixels constituted by a plurality of transistors are arranged in matrix has a source driver for supplying a video signal to the pixels, a gate driver for selecting a pixel to which a video signal is supplied, a power source circuit, a compensation circuit for compensating a characteristics change of a light-emitting element, a controller and a video memory.

According to a display device of the invention, a first substrate having a pixel portion in which pixels constituted by a plurality of transistors are arranged in matrix has a gate driver for selecting a pixel to which a video signal is supplied. The first substrate is connected to an external circuit through a connecting wire, and has a source driver for supplying a video signal to the pixels over the connecting wire; and a circuit substrate has a power source circuit, a controller, a video memory, and a compensation circuit for compensating a characteristics change of a light-emitting element.

According to a display device of the invention, a first substrate having a pixel portion in which pixels constituted by a plurality of transistors are arranged in matrix is connected to a circuit substrate through a connecting wire, and has a source driver for supplying a video signal to the pixels, and a gate driver for selecting a pixel to which a video signal is supplied over the connecting wire. The circuit substrate has a power source circuit, a controller, a video memory and a compensation circuit for compensating a characteristics change of a light-emitting element.

According to a display device of the invention, a first substrate having a pixel portion in which pixels constituted by a plurality of transistors are arranged in matrix has a gate driver for selecting a pixel to which a video signal is supplied. The first substrate is connected to a circuit substrate through a connecting wire, and has a source driver for supplying a video signal to the pixels, and a compensation circuit for compensating a characteristics change of a light-emitting element over the connecting wire; and the circuit substrate has a power source circuit, a controller, and a video memory.

According to a display device of the invention, a first substrate having a pixel portion in which pixels constituted by a plurality of transistors are arranged in matrix is connected to a circuit substrate through a connecting wire, and has a source driver for supplying a video signal to the pixels, a gate driver for selecting a pixel to which a video signal is supplied, and a compensation circuit for compensating a characteristics change of a light-emitting element over the connecting wire. The circuit substrate has a power source circuit, a controller, and a video memory.

According to a display device of the invention, a first substrate having a pixel portion in which pixels constituted by a plurality of transistors are arranged in matrix has a gate driver for selecting a pixel to which a video signal is supplied. The first substrate is connected to a circuit substrate through a connecting wire, and has a source driver for supplying a video signal to a pixel, a compensation circuit for compensating a characteristics change of a light-emitting element, and a power source circuit over the connecting wire; and the circuit substrate has a controller and a video memory.

According to a display device of the invention, a first substrate having a pixel portion in which pixels constituted by a plurality of transistors are arranged in matrix is connected to a circuit substrate through a connecting wire and has a source driver for supplying a video signal to the pixels, a gate driver for selecting a pixel to which a video signal is supplied, a compensation circuit for compensating a characteristics change of a light-emitting element, and a power source circuit over the connecting wire. The circuit substrate has a controller and a video memory.

According to a display device of the invention, a first substrate having a pixel portion in which pixels constituted by a plurality of transistors are arranged in matrix has a gate driver for selecting a pixel to which a video signal is supplied. The first substrate is connected to an external circuit through a connecting wire and has a source driver for supplying a video signal to the pixels, a compensation circuit for compensating a characteristics change of a light-emitting element, a power source circuit, a controller, and a video memory over the connecting wire.

According to a display device of the invention, a first substrate having a pixel portion in which pixels constituted by a plurality of transistors are arranged in matrix is connected to an external circuit through a connecting wire and has a source driver for supplying a video signal to the pixels, a gate driver for selecting a pixel to which a video signal is supplied, a compensation circuit for compensating a characteristics change of a light-emitting element, a power source circuit, a controller and a video memory over the connecting wire.

A driving method of a display device of the invention is that a buffer amplifier is constituted by having a monitor element, a current source for supplying a current to the monitor element, an operational amplifier, a first transistor for amplifying an output of the operational amplifier, a light-emitting element, and a second transistor for driving the light-emitting element; connecting an output terminal of the operational amplifier to a base of the first transistor; connecting an emitter terminal of a transistor to a positive power source; and connecting a collector terminal of the first transistor to an inverting input terminal of the operational amplifier. One electrode of each of the monitor element and the light-emitting element is connected to a constant potential power source, and the other electrode of the monitor element is connected to the buffer amplifier. A potential of the other electrode of the monitor element is set to be the same as a potential outputted through an amplifier, and the outputted potential is applied to the other electrode of the light-emitting element through the second transistor.

A driving method of a display device of the invention is that a buffer amplifier is constituted by having a monitor element, a current source for supplying a current to the monitor element, a capacitor for holding a voltage between opposite electrodes of the monitor element, a first switch for switching an on/off state of a connection of the capacitor and the current source, a second switch for switching an on/off state of a connection of the current source and the monitor element, an operational amplifier, a first transistor for amplifying an output of the operational amplifier, a light-emitting element, and a second transistor for driving the light-emitting element; connecting an output terminal of the operational amplifier to a base of the first transistor; connecting an emitter terminal of a transistor to a positive power source; and connecting a collector terminal of the first transistor to an inverting input terminal of the operational amplifier. One electrode of each of the monitor element and the light-emitting element is connected to a constant potential power source. When the first switch and the second switch are in an on state, the other electrode of the monitor element is connected to a buffer amplifier; a potential of the other electrode of the monitor element is set to be the same as a potential outputted through an amplifier; and the outputted potential is applied to the other electrode of the light-emitting element. When the first switch and the second switch are in an off state, the capacitor holds the other potential of the monitor element at the moment when the first switch and the second switch are turned off; the other potential of the monitor element held by the capacitor is applied to the buffer amplifier; a potential of the other electrode of the monitor element is set to be the same as a potential outputted through an amplifier; and the outputted potential is applied to the other electrode of the light-emitting element through the second transistor.

Note that, a kind of a transistor which can be applied to the invention is not limited, a thin film transistor (TFT) using a non-single crystalline semiconductor film represented by amorphous silicon or polycrystalline silicon, a MOS transistor formed by using a semiconductor substrate or an SOI substrate, a junction transistor, a bipolar transistor, a transistor using an organic semiconductor or a carbon nanotube, or other transistors can be applied. Further, a kind of a substrate on which a transistor is mounted is not limited, and the transistor can be mounted on a single crystalline substrate, an SOI substrate, a glass substrate, or the like.

Further, in the invention, a connection means an electrical connection. Therefore, in a structure disclosed by the invention, in addition to the predetermined connections, other elements which enable an electrical connection (for example, another element, switch, or the like) may be arranged therebetween.

Further, gate capacitance of a transistor or the like can substitute for a capacitor in a pixel or the like. In the case, a capacitor can be omitted.

A switch may be any switch such as an electrical switch or a mechanical switch. It may be anything as far as it can control a current. It may be a transistor, a diode, or a logic circuit configured with them. Therefore, in the case of applying a transistor as a switch, polarity (conductivity) of the transistor is not particularly limited because it operates just as a switch. It is to be noted that, when an OFF current is desired to be small, a transistor of polarity with a small OFF current is desirably used. As a transistor with a small OFF current, there is a transistor which provides an LDD region, or the like. Further, it is desirable that an n-channel type is employed when a potential of a source terminal of the transistor operating as a switch is closer to a power source on a low potential side (Vss, Vgnd, 0 V, and the like). On the contrary, a p-channel transistor is desirably employed when the potential of the source terminal is closer to a power source on a high potential side (Vdd and the like). This is because the transistor can easily operate as a switch since the absolute value of the voltage between the gate and source can be increased. Note that a CMOS switch can also be applied by using both an n-channel type and a p-channel type.

Effect of the Invention

The invention using a constant voltage drive can reduce power consumption since a driving voltage of a light-emitting element can be lowered, compared with the case where a constant current drive is used.

BEST MODE FOR CARRYING OUT THE INVENTION

Although the present invention will be fully described by way of embodiment modes and embodiments with reference to the accompanying drawings, it is to be understood that various changes and modifications will be apparent to those skilled in the art. Therefore, unless such changes and modifications depart from the scope of the invention, they should be construed as being included therein.

A basic principle of compensation of temperature and deterioration by the invention is described with reference to FIG. 1. FIG. 1 shows a schematic diagram of a display device which has a temperature and deterioration compensation circuit.

A display device of the invention is provided with a gate driver 107, a source driver 108, and a pixel portion 109. The pixel portion 109 is constituted by a plurality of pixels 106. Further, the display device of the invention has a temperature and deterioration compensation circuit (hereinafter referred to as a compensation circuit).

A basic structure of a compensation circuit is described. It has a current source 101, a monitor element 102, a buffer amplifier 103, a driving TFT 104, and a light-emitting element 105. Note that the monitor element 102 is formed of a light-emitting element which has the same current characteristics as the light-emitting element 105. For example, in the case where a light-emitting element is formed using an EL material, the monitor element 102 and the light-emitting element 105 manufacture the same EL material under the same condition.

The current source 101 supplies a constant current to the monitor element 102. That is, a current value of the monitor element 102 is always constant. When environmental temperature changes in this state, a resistance value of the monitor element 102 itself changes. When the resistance value of the monitor element 102 changes, a potential difference between opposite electrodes of the monitor element 102 changes since the current value of the monitor element 102 is constant. By detecting this potential difference of the monitor element 102, which is resulted from the change of temperature, the change of environmental temperature is detected. More specifically, since a potential of an electrode on a side held at a constant potential of the monitor element 102, that is, a potential of a cathode (constant potential power source) 110 does not change in FIG. 1, variations of a potential on a side connected to the current source 101, that is, a potential on an anode 111 side in FIG. 1 are detected.

FIG. 2 is a diagram showing temperature dependence of voltage-current characteristics of a monitor element. Voltage-current characteristics of the monitor element 102 at room temperature, lowered temperature, and raised temperature are shown by lines 201, 202, and 203 respectively. When a current value which flows from the current source 101 to the monitor element 102 is $I_0$, a voltage of $V_0$ is applied to a monitor element at room temperature. Further, a voltage of $V_1$ is applied at lowered temperature, and a voltage of $V_2$ is applied at raised temperature.

Data including such variations of the voltage of the monitor element 102 is supplied to the buffer amplifier 103, and a potential supplied to the light-emitting element 105 in the buffer amplifier 103 is set on the basis of a potential of the anode 111. That is, in the case where environmental temperature is lowered as shown in FIG. 2, a potential is set so that a voltage of V1 is applied to the light-emitting element 105, and in the case of raised temperature, a potential is set so that a voltage of V2 is applied to the light-emitting element 105. Then, a power source potential to be inputted to the light-emitting element 105 can be corrected in accordance with variations of temperature. That is, variations of a current value, which is resulted from variations of temperature, can be suppressed.

Further, FIG. 3 is a diagram showing deterioration with time of voltage-current characteristics of the monitor element 102. Primary characteristics of the monitor element 102 are shown by a line 301, characteristics after deterioration are shown by 302. Note that the primary characteristics and the characteristics after deterioration are measured at the same temperature. When the current $I_0$ flows to the monitor element 102 in a state of the primary characteristics, a voltage applied to the monitor element 102 is $V_3$, and a voltage applied to the monitor element 102 after deterioration is $V_4$. Therefore, if this voltage of $V_4$ is to be applied to the light-emitting element 105, apparent deterioration of the light-emitting element 105 can be reduced. Thus, since the monitor element 102 is also deteriorated together with the light-emitting element 105, deterioration of the light-emitting element 105 can also be compensated.

Thus, a voltage follower circuit using an operational amplifier 601 which is shown in FIG. 6A can be applied to the buffer amplifier 103 for setting the same potential for an abode of the light-emitting element 105 in accordance with a potential change of the anode 111 of the monitor element 102. This is because, since a non-inverting input terminal of the voltage follower circuit has a high input impedance, and an output terminal has a low output impedance, the input terminal and the output terminal are set to have the same potential, and a current can be applied from the output terminal without supplying a current of the current source 101 to the voltage follower circuit.

Alternatively, the buffer amplifier 103 may be constituted by connecting an output terminal of an operational amplifier 602 to a base of a transistor 603; connecting an emitter terminal of the transistor 603 to a positive power source; and connecting a collector terminal of the transistor 603 to an inverting input terminal of the operational amplifier 602 as shown in FIG. 6B. In this case, since a current can be amplified by a transistor, an output load of an operational amplifier can be reduced. As a circuit, it is equivalent to the voltage follower circuit shown in FIG. 6A. Hereafter, in the specification, a structure shown in FIG. 6B can be applied to a portion described as the voltage follower circuit.

A specific structure of a display device having a compensation circuit of this embodiment mode is described with reference to FIG. 7. The display device has a gate driver 707, a source driver 708, and a pixel portion 709. The source driver has a pulse output circuit 710, a first latch circuit 170, and a second latch circuit 711. When an input to the first latch circuit is carried out, an output can be carried out in the second latch circuit. Further, a switching transistor 712 of a pixel 706 selected by a gate line to which a signal is inputted from the gate driver 707 is turned on. Further, a signal outputted from the second latch circuit 711 is written to a storage capacitor 713 from source signal lines S1 to Sm. A driving transistor 704 switches between an on state and an off state by the signal written to the storage capacitor 713 so that a light-emitting element is determined to emit light or no light. That is, potentials of power source lines V1 to Vm are set to be an anode of a light-emitting element 705 through the driving transistor 704 in an on state, and a current is supplied to the light-emitting element 705 so that light is emitted.

In the invention, a current flows from a basic current source 701 to monitor elements 702*a* to 702*n* that are connected in parallel. Potentials of an anode of the monitor elements 702*a* to 702*n* are detected, and a potential is set for the power source lines V1 to Vm by a voltage follower circuit 703. Thus, a display device provided with a compensating function of temperature and deterioration can be provided.

Such a driving method provided with a compensating function for temperature and deterioration is also referred to as constant brightness.

Note that the number of monitor elements can be appropriately selected. Needless to say, one monitor element may be provided, or a plurality of monitor elements may be arranged as shown in FIG. 7. Since a current value of the basic current source 701 is set to be a current value which is desired to be supplied to the light-emitting element 705 of each pixel when only one monitor element is used, power consumption can be small. Further, if a plurality of monitor elements are arranged, variations in characteristics of each monitor element can be averaged.

Note that, although a cathode of the light-emitting element 705 of each pixel is set to be GND in a structure of FIG. 7, the invention is not limited to this.

Further, a potential of a power source line can be set by each pixel of RGB. One of the examples is shown in FIG. 8. Common symbols are used for the same portions as the display device of FIG. 7. Further, specific operation is omitted since it is the same as FIG. 7.

Further, the pixel 706 is not limited to such a structure, and a structure shown in FIG. 9 can also be applied. A pixel 906 shown in FIG. 9 has a switching transistor 901, a driving transistor 902, an erasing transistor 903, a capacitor 904, and a light-emitting element 905.

In a display device of FIG. 8, a pixel connected to a signal line S1 is a pixel which emits light of R, a pixel connected to a signal line S2 is a pixel which emits light of G, and a pixel connected to a signal line S3 is a pixel which emits light of B. A basic current source 801*a* supplies a current to a monitor element 802*a*, a voltage follower circuit 803*a* detects a potential of an anode of the monitor element 802*a*, and the potential is set for the power source line V1. A basic current source

801*b* supplies a current to a monitor element 802*b*, a voltage follower circuit 803*b* detects a potential of an anode of the monitor element 802*b*, and the potential is set for the power source line V2. A basic current source 801*c* supplies a current to a monitor element 802*c*, a voltage follower circuit 803*c* detects a potential of an anode of the monitor element 802*c*, and the potential is set for the power source line V3. Thus, since a potential can be set per RGB, for example, when characteristics of temperature or characteristics of deterioration differ from one EL material to another of each of RGB, a predetermined potential can be set for a light-emitting element. That is, a power source potential can be corrected per RGB.

Embodiment Mode 1

In this embodiment mode, description is made on a structure in which precision of compensation for deterioration is further improved.

If a display device is continuously used for a long time, an error is occurred in progress of deterioration between a monitor element and a light-emitting element. The longer the period of service is, the bigger the error grows, and a function of compensation of deterioration is deteriorated.

Here, description is made on the case where an error is occurred in deterioration with reference to FIG. 4. Primary characteristics of voltage-current characteristics of the monitor element 102 and the light-emitting element 105 are denoted by a line 401, characteristics after deterioration of the monitor element 102 in the case where a display device is used for a certain period is shown by a line 402, and characteristics after deterioration of the light-emitting element 105 is shown by a line 403. Thus, there is a difference in progress of deterioration between the monitor element 102 and the light-emitting element 105. This is because a current always continues to flow to the monitor element 102 when the display device performs display. However, since there are a light-emitting period and a no light-emitting period in each of the light-emitting elements 105 of a pixel, an error occurs in deterioration with time between the monitor element 102 and the light-emitting element 105. That is, progress of deterioration of a light-emitting element is delayed compared with deterioration of a monitor element.

Here, in the primary characteristics of the monitor element 102, when a current of a current value $I_0$ flows to the monitor element 102, a voltage of $V_5$ is applied to a monitor element in primary characteristics. In addition, after deterioration of the light-emitting element 105, a voltage of $V_6$ is applied, and after deterioration of the monitor element 102, a voltage of $V_7$ is applied. Conversely, the voltage of $V_6$ is required to be applied in order to apply the current value $I_0$ to the light-emitting element 105 after deterioration, and the voltage of $V_7$ is required to be applied in order to apply the current value $I_0$ to the monitor element 102 after deterioration.

If a potential $V_7$ of the anode 111 of the monitor element 102 is detected under this condition, and the potential $V_7$ is set for a light-emitting element by the buffer amplifier 103, a voltage higher than a voltage $V_6$ which is necessary to supply the current value $I_0$ to a light-emitting element is applied so that power consumption becomes large. Further, since progress of deterioration differs from one light-emitting element to another of a pixel, when a voltage higher than required is applied, a screen burn becomes prominent.

In this embodiment mode, progress of deterioration of each light-emitting element is set closer to progress of deterioration of a monitor element; thereby precision of compensation for deterioration is improved.

Therefore, in this embodiment mode, an averaged period of a light-emitting period of a light-emitting element in each pixel of a display device is set to be a period of a current which flows to the monitor element. Preferably, a current flows to a monitor element during 10 to 70% of the period when a display device performs display.

Here, it is empirically known that an average value of the ratio of a light-emitting period to a no light-emitting period of a light-emitting element in each pixel in a display device is 3:7. Therefore, more preferably, a current is supplied to a monitor element during 30% of the period when a display device performs display.

A structure of a compensation circuit which can set a light-emitting period of a monitor element is shown in FIG. 5. It has a current source 501, a monitor element 502, a voltage follower circuit 503, a driving transistor 504, a light-emitting element 505, a capacitor 506, a first switch 507, and a second switch 508.

When a constant current is supplied to the monitor element 502, the first switch 507 and the second switch 508 are turned on. Then, a current flows to the monitor element 502; and as a potential on an anode 509 side of the monitor element 502 is accumulated in the capacitor 506, the potential is inputted to the non-inverting input terminal of the voltage follower circuit 503, and the same potential is outputted to an output terminal. Thus, a desired potential can be set for the light-emitting element 105 in which voltage-current characteristics are changed by the change of environmental temperature.

When the monitor element 502 emits no light, the first switch 507 and the second switch 508 are turned off, and a potential on the anode 509 side of the monitor element 502 is held in the capacitor 506. At this time, the second switch 508 is turned off at the same time as or at least before the first switch 507. If the first switch 507 is turned off before the second switch 508, a potential of a capacitor in which a potential on an anode side of the monitor element 502 is accumulated varies.

Thus, also in a no light-emitting period, a potential on the anode 509 side of the monitor element 502 at the moment when the second switch 508 is turned off is inputted to the non-inverting input terminal of the voltage follower circuit 503. Then, the same potential is outputted at the output terminal of the voltage follower circuit 503, and a current flowing to the monitor element 502 at the moment when the second switch 508 is turned off can be supplied to a light-emitting element.

Since a function of compensation for temperature can be achieved during the period when a current is supplied to a monitor element in this structure, both compensation for deterioration and compensation for temperature can be realized. In this embodiment mode, a function of compensation for deterioration is specifically excellent.

Here, it is empirically known that an average value of the ratio of light emission to no light emission of each pixel during each frame period is the ratio of 30:70 in time gray-scale display of a display device. Therefore, the average ratio of an amount of a current flowing to a monitor element which continues to supply a current while display of a display device is performed to an amount of a current flowing to each light-emitting element is 100:30. Therefore, by setting a period when a current is supplied to a monitor element to be 30% per frame period, progress of deterioration of a monitor element can be set closer to progress in deterioration of a light-emitting element of a pixel. That is, precision of compensation for deterioration can be improved.

Further, in the abovementioned structure, a monitor element for compensating deterioration is provided per RGB so that a function of compensating deterioration and temperature with improved precision can be realized. In the case where progress of deterioration and operating life of EL differ by RGB, or in the case where characteristics of temperature of a flowing current differ by RGB, it is preferable that compensation of temperature and compensation for deterioration be carried out by providing a monitor element corresponding to a light-emitting element of each of RGB. Further, by setting a light-emitting period of a monitor element of each of RGB in accordance with an average value of the ratio (duty ratio) of a light-emitting period to a no light-emitting period of each light-emitting period of RGB, precision of compensation for deterioration is further improved. That is, since average values of progress of deterioration of a monitor element and progress of deterioration of each light-emitting element are almost equivalent, a system of compensation for deterioration is further improved. Further, since an EL material of the same color can be used for a monitor element, precision of compensation for temperature of a light-emitting element can also be improved. Such a structure can be realized by applying to a display device shown in FIG. 8.

Embodiment Mode 2

In this embodiment mode, description is made on a structure of a display device capable of suppressing power consumption and compensating variations in characteristics of an element, which are caused by temperature and deterioration.

Description is made with reference to a block diagram in FIG. 29 on components which are necessary when a display device is constituted. A power source circuit 1107 is a circuit for making a plurality of potentials which are necessary in a display device from a power source supplied externally such as a battery, and supplies a power source to a source driver 1104 for supplying a display signal to a pixel portion 1103; a gate driver 1105 for selecting a pixel which supplies a display signal; a controller 1108; and the like. A video memory 1109 is a device for saving image data which is inputted externally and drive data of the display device.

Further, the controller 1108 is a device for making signals which are necessary for a display device to perform display from image data which is inputted from the external such as a CPU by using the video memory 1109 as required, and supplies a signal to the source driver 1104 and the gate driver 1105. The controller 1108 controls the power source circuit 1107, and a potential which is necessary in the source driver 1104, the gate driver 1105, and the pixel portion 1103 is made in the power source circuit 1107 in some cases.

Further, description is made with reference to a block diagram in FIG. 30 on components which are necessary when a display device capable of compensating variations in characteristics of a light-emitting element is constituted. Description is omitted for the controller 1108, the video memory 1109, the source driver 1104 and the gate driver 1105, since the function is the same. Although description is already made on a function of a compensation circuit 1110 in this specification, it is a circuit which senses variations in characteristics of a monitor pixel 1111 and determines a power source potential to be supplied to the pixel portion 1103 in accordance with variations in characteristics of a monitor pixel.

FIG. 11 shows a structure of a display device capable of suppressing power consumption. A first substrate (display substrate) 1101 having the pixel portion 1103 in which pixels constituted by a plurality of transistors are arranged in matrix has the source driver 1104 and the gate driver 1105; the first substrate 1101 is connected to a circuit substrate (second substrate) 1102 through a connecting wire 1106; and the circuit substrate 1102 has the power source circuit 1107, the controller 1108, and the video memory 1109.

The source driver 1104 may be constituted by a transistor formed in the same layer as a transistor which constitutes a pixel circuit, or may be manufactured in another step and mounted on the first substrate 1101.

In the case where the source driver 1104 is constituted by a transistor formed in the same layer as a transistor which constitutes a pixel circuit, the number of pieces and the cost can be reduced compared with the case where a driver IC which is manufactured in another step is mounted.

On the other hand, when the source driver 1104 is manufactured in another step and mounted on the first substrate 1101, a driving voltage can be lowered and low power consumption can be realized in the case where the transistor characteristics of the transistor which is manufactured in another step is superior such that, for example, mobility is high and variations in characteristics such as a threshold are small compared with that of a transistor which is manufactured in a process where the first substrate is manufactured.

Specifically, in the case where time gray scale drive is used, in which one frame period is divided into a plurality of frames, and a gray scale is expressed by the length of a sum of light-emitting periods, multiple gray scales of more than eight bits can be displayed, and smooth display can be provided, since a source driver can operate at a high speed by using a source driver for which a transistor superior in characteristics is used as mentioned above.

The gate driver may be constituted by a transistor formed in the same layer as a transistor which constitutes a pixel circuit, or may be manufactured in another step and mounted on the first substrate 1101.

In the case where the gate driver 1105 is constituted by a transistor formed in the same layer as a transistor which constitutes a pixel circuit, the number of pieces and the cost can be reduced compared with the case where a driver IC which is manufactured in another step is mounted.

On the other hand, when the gate driver 1105 is manufactured in another step and mounted on the first substrate 1101, high yield and low power consumption can be realized in the case where the transistor characteristics of the above-mentioned another step is superior such that, for example, mobility is high and variations in characteristics such as a threshold are small compared with that of a step where the first substrate is manufactured.

Although each of the power source circuit 1107, the controller 1108, and the video memory 1109 may be mounted on the circuit substrate 1102 as a different IC, they may also be mounted over one IC. In this case, since the number of pieces and the cost can be reduced, and at the same time, a mount area over the circuit substrate 1102 can be downsized, a display device can be downsized. Further, a coil and a capacitor that are difficult to be provided in one IC may be mounted on the circuit substrate 1102 directly.

Although a component of these ICs may be a CMOS IC or a bipolar IC, a stack of a COMS IC and the bipolar IC or a BiCMOS IC may be used to provide a product which suppresses power consumption to be low and has high capability of supplying a power source.

FIG. 12 shows a structure of a display device capable of suppressing power consumption and compensating variations in characteristics of an element, which are caused by temperature and deterioration. The compensation circuit 1110 is provided over the circuit substrate 1102 which has a structure shown in FIG. 11.

Each of the power source circuit 1107, the controller 1108, the video memory 1109, and the compensation circuit 1110 may be mounted on the circuit substrate 1102 as different ICs, or they may also be mounted over one IC. Further, a coil and a capacitor that are difficult to be provided over one IC may be mounted on the circuit substrate 1102 directly.

FIG. 13 shows a structure of a display device capable of suppressing power consumption and compensating variations in characteristics of an element, which is caused by temperature and deterioration. The compensation circuit 1110 is provided over the first substrate 1101 which has a structure shown in FIG. 11.

The compensation circuit 1110 is preferably constituted by a transistor formed in the same layer as a transistor which constitutes a pixel circuit. In this case, since the compensation circuit 1110 can be manufactured in the same process as the first substrate 1101, the number of pieces and the cost can be reduced. It is to be noted that, when lacking a capability of supplying a current in the case where a compensation circuit is constituted by using a transistor in the same layer as a transistor which constitutes a pixel circuit, a current may be amplified by providing a transistor over the circuit substrate 1102 or in the power source circuit 1107.

Further, the compensation circuit 1110 may be manufactured with the source driver 1104 in another step, and integrated in one IC to be mounted on the first substrate 1101; and compensation for temperature and deterioration can be obtained without increasing the number of pieces, compared with the case where the source driver 1104 is manufactured in another step. In this case, when lacking a capability of supplying a current, a current may be amplified by providing a transistor over the circuit substrate 1102 or in the power source circuit 1107.

FIG. 14 shows a structure of a display device capable of suppressing power consumption. The first substrate 1101 having the pixel portion 1103 in which pixels constituted by a plurality of transistors are arranged in matrix has the source driver 1104 and the gate driver 1105; the first substrate 1101 is connected to the circuit substrate 1102 through the connecting wire 1106; the circuit substrate 1102 has the controller 1108 and the video memory 1109; and the power source circuit 1107 is provided over the connecting wire 1106.

Since a mount area over the circuit substrate 1102 can be downsized by providing the power source circuit 1107 over the connecting wire 1106, downsizing an entire display device can be achieved. In this case, although the power source circuit 1107 needs a coil or a capacitor in some cases, the coil and the capacitor may be provided over the connecting wire 1106 or the circuit substrate 1102, or they may be provided over both of them such that the small capacitor and the like are provided over the connecting wire 1106, and the large coil and the like are provided over the circuit substrate 1102.

Further, a bipolar IC, a combination of a CMOS IC and a bipolar transistor, a stack of a bipolar IC and a CMOS IC, or a BiCMOS IC may be used to provide components of the power source circuit 1107. In this case, both low power consumption and high current supply can be managed.

FIG. 15 shows a structure of a display device capable of suppressing power consumption and compensating variations in characteristics of an element, which are caused by temperature and deterioration. The compensation circuit 1110 is provided over the first substrate 1101 which has a structure shown in FIG. 14.

The compensation circuit 1110 may be constituted by using a transistor in the same layer as a transistor which constitutes a pixel in the pixel portion 1103, and a product manufactured in another step may be mounted on the first substrate 1101. Further, it may be constituted by one IC which is the same as the source driver 1104, or they may be manufactured as a different IC in each and stacked.

FIG. 16 shows a structure of a display device capable of suppressing power consumption and compensating variations in characteristics of an element, which is caused by temperature and deterioration. The compensation circuit 1110 is provided over the connecting wire 1106 which has the structure shown in FIG. 14.

Although the compensation circuit 1110 may be an independent IC, the number of pieces and the cost can be reduced by integrating as the same ICs as the power source circuit 1107.

FIG. 17 shows a structure of a display device capable of suppressing power consumption. The first substrate 1101 having the pixel portion 1103 in which pixels constituted by a plurality of transistors are arranged in matrix has the source driver 1104, the gate driver 1105, and the power source circuit 1107; the first substrate 1101 is connected to the circuit substrate 1102 through the connecting wire 1106; and the circuit substrate 1102 has the controller 1108 and the video memory 1109.

By providing a power source circuit over the first substrate 1101, a mount area over the circuit substrate 1102 can be downsized. In addition, by constituting the video memory 1109 and the controller 1108 which are over the circuit substrate 1102 into one IC, a mount area over the circuit substrate 1102 can be downsized, and downsizing a display device can be achieved.

By constituting both of the source driver 1104 and the power source circuit 1107 which are over the first substrate 1101 by a transistor over the same layer as a transistor constituting a pixel, the number of pieces can be reduced, and the manufacturing cost can be held down. Here, although a coil and a capacitor, which are necessary in a power source circuit, may be manufactured over the first substrate 1101 by the same way as a transistor, in the case where they cannot be manufactured, or their capability is not enough, a coil and a capacitor which are manufactured in another process are preferably used, and they may be mounted on the first substrate 1101, provided over the connecting wire 1106, provided over the circuit substrate 1102, or provided in a plurality of places such that a capacitor is over the first substrate 1101, and a coil is over the connecting wire 1106.

The source driver 1104 and the power source circuit 1107 which are over the first substrate 1101 may be mounted as an IC manufactured in a different process from that of the first substrate 1101. By using a CMOS IC for the source driver 1104, and using a bipolar IC for the power source circuit 1107, both low power consumption and high capability of supplying a power source can be managed. Here, by arranging a stack of the source driver 1104 using a MOS IC and the power source circuit 1107 using a bipolar IC, a mount area over the first substrate 1101 can be downsized. Further, by using a BiCMOS IC, the source driver 1104 and the power source circuit 1107 can be constituted by one IC. Also in this case, both low power consumption and high capability of supplying a power source can be managed, and a mount area over the first substrate 1101 can be downsized.

In the case where a power source circuit is constituted by a bipolar IC or a BiCMOS IC, a coil and a capacitor may be provided over the first substrate 1101, the circuit substrate 1102, or the connecting wire 1106, or they may be provided over a plurality of places such that the capacitor is over the first substrate 1101, and the coil is over the connecting wire 1106.

FIG. 18 shows a structure of a display device capable of suppressing power consumption and compensating variations in characteristics of an element, which are caused by temperature and deterioration. The compensation circuit 1110 is provided over the first substrate 1101 which has a structure shown in FIG. 17.

The compensation circuit 1110 may be constituted by using a transistor in the same layer as a transistor which constitutes a pixel in the pixel portion 1103, and one manufactured in another process may be mounted on the first substrate 1101. Further, although each of the source driver 1104, the power source circuit 1107, and the compensation circuit 1110 may be mounted as different ICs, by integrating functions and decreasing the number of ICs to be mounted, the manufacturing cost can be reduced, and a mount area can be downsized and at the same time a display device can be downsized. For example, since both low power consumption and high capability of supplying a power source can be managed by one IC, using a BiCMOS IC is appropriate for integrating functions.

FIG. 19 shows a structure of a display device capable of suppressing power consumption. The first substrate 1101 having the pixel portion 1103 in which pixels constituted by a plurality of transistors are arranged in matrix has the source driver 1104, the gate driver 1105, the power source circuit 1107, the controller 1108, and the video memory 1109, and image data and a power source are supplied through the connecting wire 1106.

By manufacturing each of the source driver 1104, the gate driver 1105, the power source circuit 1107, the controller 1108, and the video memory 1109 by using a transistor in the same layer as a transistor which constitutes the pixel portion 1103, the number of pieces can be reduced, and the manufacturing cost can be held down.

Further, the source driver 1104, the gate driver 1105, the power source circuit 1107, the controller 1108, and the video memory 1109 each of which is manufactured as an independent IC in a different step from that of the first substrate 1101, may be mounted on the first substrate 1101. Further, since a rapid operation is not required for the gate driver 1105, only the gate driver 1105 may be manufactured by using a transistor in the same layer as a transistor which constitutes the pixel portion 1103, and the source driver 1104, the power source circuit 1107, the controller 1108, and the video memory 1109 may be manufactured in another step, and mounted on the first substrate 1101.

As ICs constituting the above-mentioned, are preferably used appropriately such that a bipolar IC is preferably used for the power source circuit 1107, and a CMOS IC is preferably used for a driver portion and the controller 1108. By stacking the plurality of ICs to be one chip, a mount area can be downsized, and downsizing of a display device can be achieved. Further, by using a BiCMOS IC, a bipolar IC and a CMOS IC that are manufactured separately in accordance with a function can be integrated into one IC, a mount area can be downsized, and downsizing of a display device can be achieved.

Further, in the case where it is difficult to incorporate a capacitor and a coil over the first substrate 1101 or an IC which constitutes a power source circuit, or a capability is not enough, a coil and a capacitor may be mounted on the first substrate 1101 or the connecting wire 2206.

FIG. 20 shows a structure of a display device capable of suppressing power consumption and compensating variations in characteristics of an element, which are caused by temperature and deterioration. The compensation circuit 1110 is provided over the first substrate 1101 which has a structure shown in FIG. 19.

The compensation circuit 1110 may be constituted by using a transistor over the same layer as a transistor which constitutes a pixel in the pixel portion 1103, or one manufactured in another step may be mounted on the first substrate 1101. Further, it may be constituted by one IC which is the same as the source driver 1104, or each piece manufactured as a different IC may be mounted, or each piece manufactured as a different IC may be stacked and mounted.

FIG. 21 shows a structure of a display device capable of suppressing power consumption. The first substrate 1101 having the pixel portion 1103 in which pixels constituted by a plurality of transistors are arranged in matrix has the gate driver 1105; the first substrate 1101 is connected to the circuit substrate 1102 through the connecting wire 1106; the circuit substrate 1102 has the power source circuit 1107, the controller 1108, and the video memory 1109; and the source driver 1104 is provided over the connecting wire 1106.

Since a mount area over the first substrate 1101 can be downsized by providing the source driver 1104 over the connecting wire 1106, an area of a peripheral portion except the pixel portion 1103 over the first substrate 1101 can be downsized, and downsizing of a display device can be achieved. Further, since a structure of an element over the circuit substrate 1102 is the same as a structure shown in FIG. 11, it is omitted. Note that the gate driver 1105 may be provided over the connecting wire 1106.

FIG. 22 shows a structure of a display device capable of suppressing power consumption and compensating variations in characteristics of an element, which are caused by temperature and deterioration. The compensation circuit 1110 is provided over the circuit substrate 1102 which has a structure shown in FIG. 21.

A structure of an element over the circuit substrate 1102 at this time is omitted since it is the same as a structure shown in FIG. 11.

FIG. 23 shows a structure of a display device capable of suppressing power consumption and compensating variations in characteristics of an element, which are caused by temperature and deterioration. The compensation circuit 1110 is provided over the connecting wire 1106 which has the structure shown in FIG. 21.

The compensation circuit 1110 may be manufactured with the source driver 1104 in a different step from that of the first substrate 1101, and integrated into one IC to be mounted on the connecting wire 1106; and compensation for temperature and deterioration can be obtained without increasing the number of pieces, compared with the case where the source driver 1104 is manufactured by a structure shown in FIG. 22 in another step. Also in this case, when lacking a capability of supplying a current, a current may be amplified by providing a transistor over the circuit substrate 1102 or in the power source circuit 1107.

FIG. 24 shows a structure of a display device capable of suppressing power consumption. The first substrate 1101 having the pixel portion 1103 in which pixels constituted by a plurality of transistors are arranged in matrix has the gate driver 1105; the first substrate 1101 is connected to the circuit substrate 1102 through the connecting wire 1106; the circuit substrate 1102 has the controller 1108 and the video memory 1109; and the source driver 1104 and the power source circuit 1107 are provided over the connecting wire 1106.

Since a mount area over the first substrate 1101 and the circuit substrate 1102 can be downsized by providing the source driver 1104 and the power source circuit 1107 over the connecting wire 1106, downsizing of a display device can be achieved.

By using an IC including a CMOS for the source driver 1104, and using a bipolar IC for the power source circuit 1107, both low power consumption and high capability of supplying a power source can be managed. Here, by arranging a stack of the source driver 1104 using an IC including a CMOS and the power source circuit 1107 using a bipolar IC, a mount area over the connecting wire 1106 can be downsized. Further, by using an IC including a BiCMOS, the source driver 1104 and the power source circuit 1107 can be constituted by one IC. Also in this case, both low power consumption and high capability of supplying a power source can be managed, and a mount area over the connecting wire 1106 can be downsized.

When it is difficult to incorporate a coil and a capacitor into an IC in the case where a power source circuit is constituted by an IC including a bipolar IC or a BiCMOS, a coil and a capacitor may be provided over the connecting wire 1106 or the circuit substrate 1102, or they may be provided over a plurality of places such that a capacitor is over the circuit substrate 1102, and a coil is over the connecting wire 1106.

FIG. 25 shows a structure of a display device capable of suppressing power consumption and compensating variations in characteristics of an element, which are caused by temperature and deterioration. The compensation circuit 1110 is provided over the connecting wire 1106 which has a structure shown in FIG. 24.

Although each of the source driver 1104, the power source circuit 1107, and the compensation circuit 1110 may be mounted as different ICs, by integrating functions and decreasing the number of ICs to be mounted, the manufacturing cost can be reduced and a mount area can be downsized at the same time so that downsizing of a display device can be achieved. For example, since both low power consumption and high capability of supplying a power source can be managed by one IC by using an IC including a BiCMOS, it is appropriate for integrating functions.

FIG. 26 shows a structure of a display device capable of suppressing power consumption. The first substrate 1101 having the pixel portion 1103 in which pixels constituted by a plurality of transistors are arranged in matrix has the gate driver 1105; the controller 1108, the video memory 1109, the source driver 1104, and the power source circuit 1107 are provided over the connecting wire 1106 which is connected to the first substrate 1101.

Since the circuit substrate 1102 which is needed in FIG. 24 can be eliminated by providing the controller 1108, the video memory 1109, the source driver 1104, and the power source circuit 1107 over the connecting wire 1106, downsizing of a display device can be achieved.

Further, each of the source driver 1104, the power source circuit 1107, the controller 1108, and the video memory 1109, which are manufactured in a different process from that of the first substrate 1101 as independent ICs, may be mounted on the connecting wire 1106.

ICs constituting the abovementioned are preferably used appropriately such that a bipolar IC is used for the power source circuit 1107, and an IC including a CMOS is used for a driver portion and the controller 1108. By stacking the plurality of ICs to be one chip, a mount area can be downsized, and downsizing of a display device can be achieved. Further, by using an IC including a BiCMOS, a bipolar IC and an IC including a CMOS that are manufactured separately in accordance with a function can be integrated in one IC, a mount area can be downsized, and downsizing of a display device can be achieved.

Further, in the case where it is difficult to incorporate a capacitor and a coil into an IC which constitutes a power source circuit, or performance is not enough, a coil and a capacitor may be mounted on the connecting wire 2206.

FIG. 27 shows a structure of a display device capable of suppressing power consumption and compensating variations in characteristics of an element, which are caused by temperature and deterioration. The compensation circuit 1110 is provided over the connecting wire 1106 which has a structure shown in FIG. 26.

The compensation circuit 1110 may be constituted by one IC which is the same as the source driver 1104, or each piece may be manufactured as a different IC and mounted, or each piece manufactured as a different IC may be stacked to be one chip and mounted.

Embodiment 1

As electronic appliances provided with a pixel region including a light-emitting element, a television device (television, television receiver), a digital camera, a digital video camera, a mobile phone device (mobile phone), a portable information terminal such as a PDA, a portable game machine, a monitor, a computer, an audio reproducing device such as a car audio, an image reproducing device provided with a recording medium such as a home-use game machine, and the like can be cited. A display device of the invention can be applied to a display portion of these electronic appliances. Specific examples of the electronic appliances are described with reference to FIG. 28.

A portable information terminal using a display device of the invention, which is shown in FIG. 28A, includes a main body 9201, a display portion 9202, and the like, and can reduce power consumption by using the invention. A digital video camera using a display device of the invention, which is shown in FIG. 28B, includes a display portions 9701 and 9702, and the like, and can reduce power consumption by using the invention. A portable terminal using a display device of the invention, which is shown in FIG. 28C, includes a main body 9101, a display portion 9102, and the like, and can reduce power consumption by using the invention. A television device using a display device of the invention, which is shown in FIG. 28D, includes a main body 9301, a display portion 9302, and the like, and can reduce power consumption by using the invention. A portable computer using a display device of the invention, which is shown in FIG. 28E, includes a main body 9401, a display portion 9402, and the like, and can reduce power consumption by using the invention. A television device using a display device of the invention, which is shown in FIG. 28F, includes a main body 9501, a display portion 9502, and the like, and can reduce power consumption by using the invention. In the electronic appliances cited above, the one using a battery can be used for a long time since power consumption is reduced, and a trouble of charging a battery can be omitted.

EXPLANATION OF REFERENCE

Figure 1:
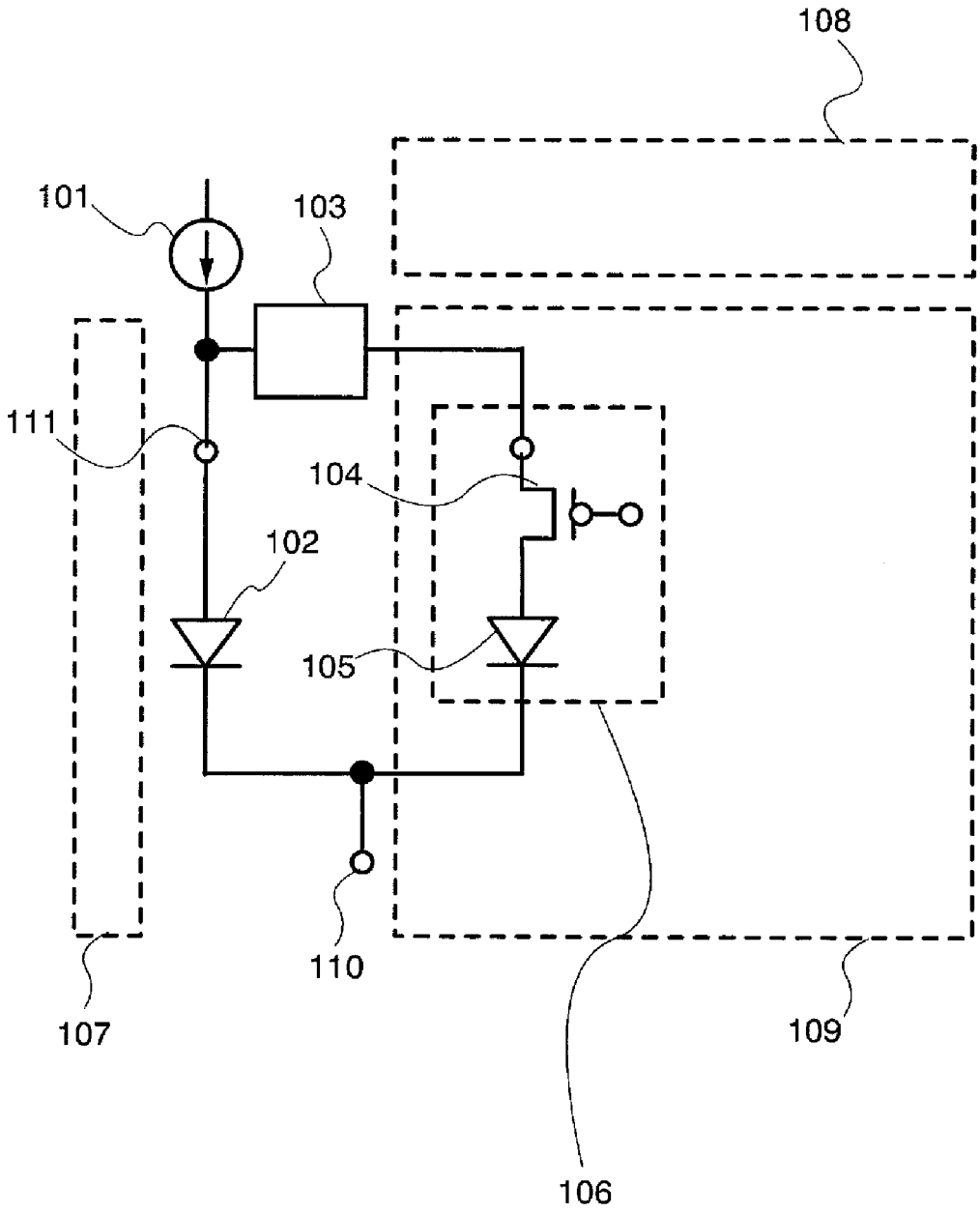
FIG. 1 A diagram explaining a display device of the invention.
Figure 2:
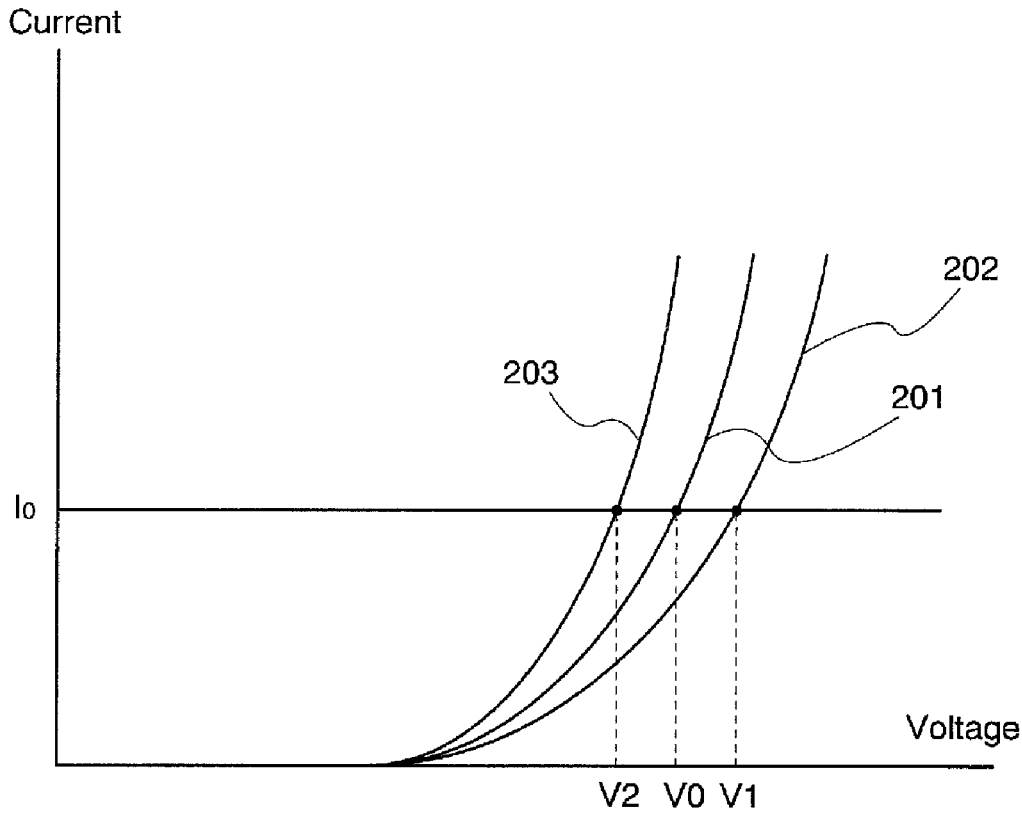
FIG. 2 A diagram explaining temperature dependence of voltage-current characteristics.
Figure 3:
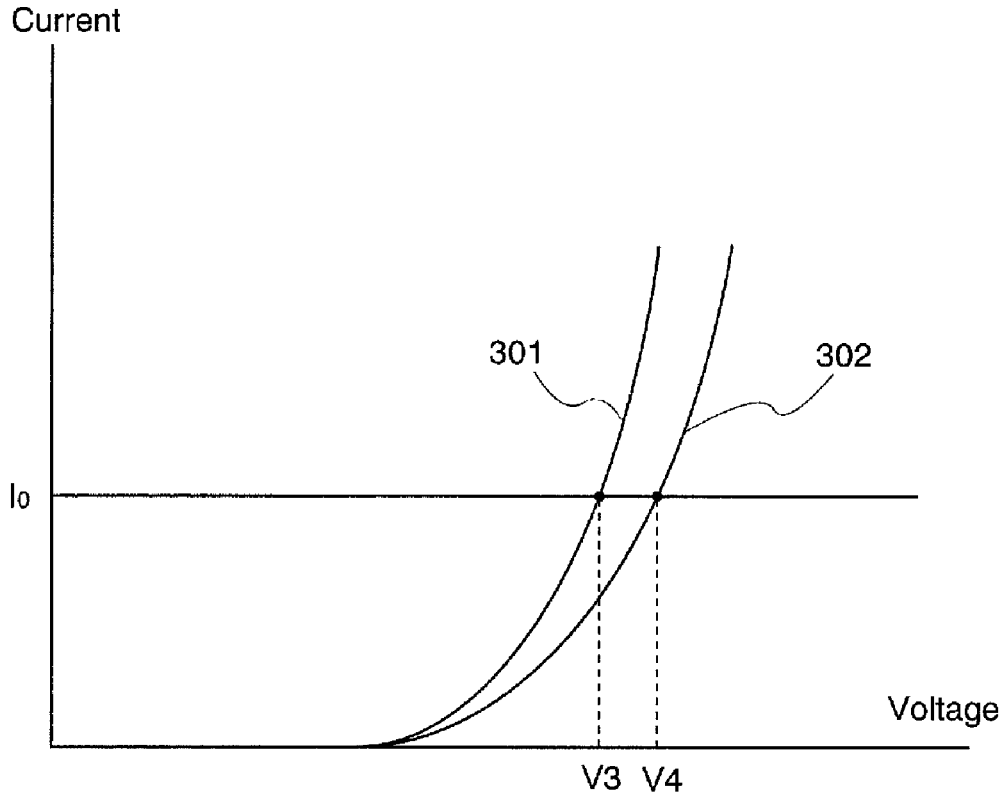
FIG. 3 A diagram explaining deterioration with time of voltage-current characteristics.
Figure 4:
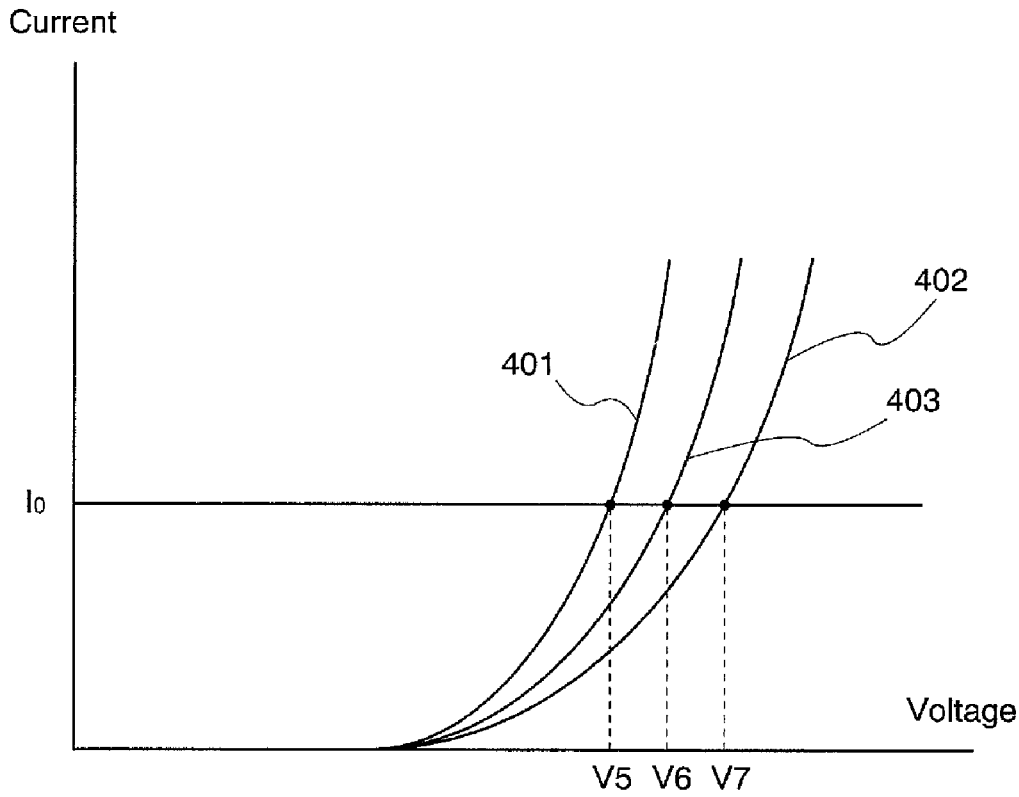
FIG. 4 A diagram explaining deterioration of a monitor element and a light-emitting element.
Figure 5:
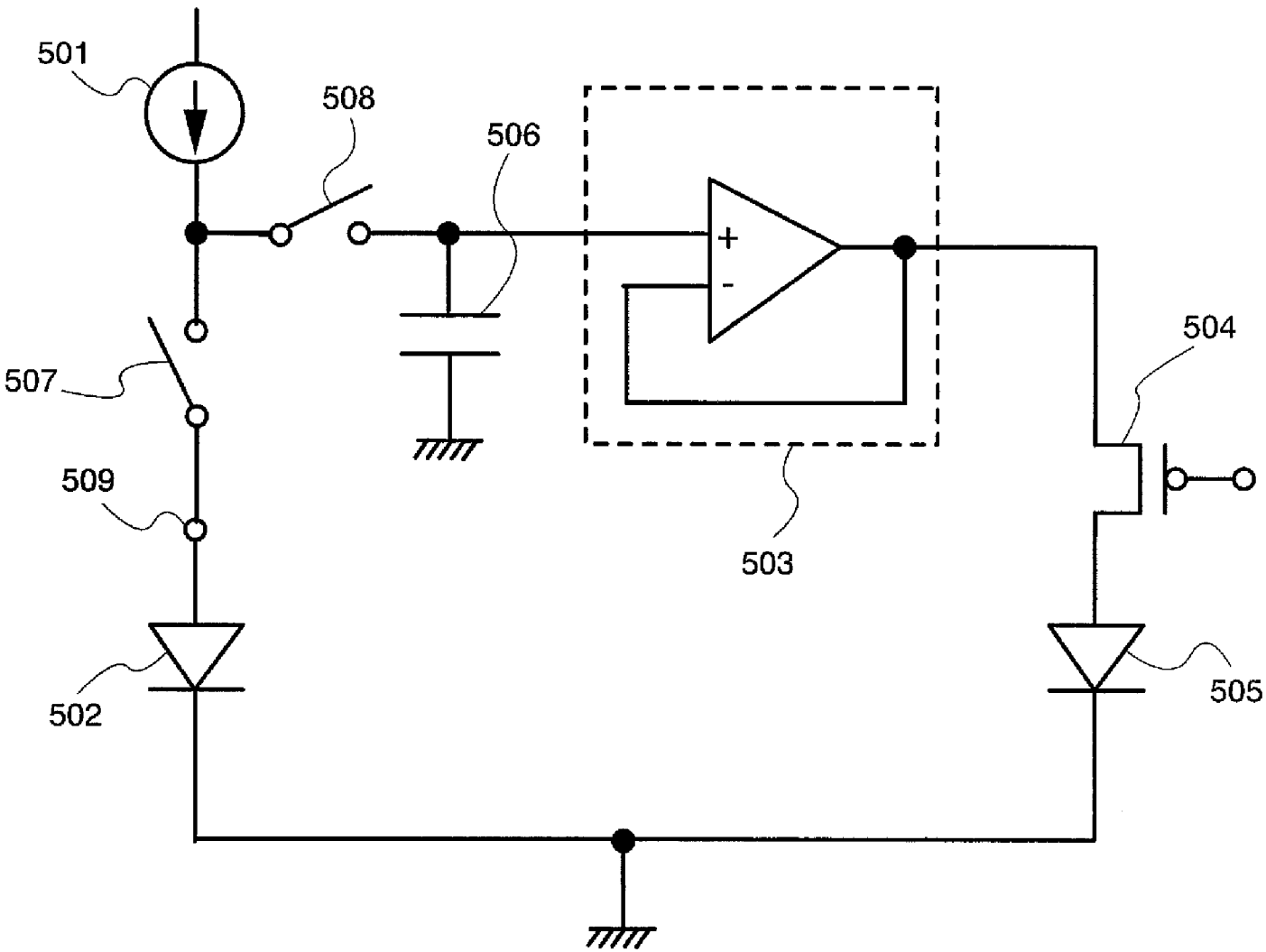
FIG. 5 A diagram explaining a function of compensating temperature of the invention.
Figure 6:
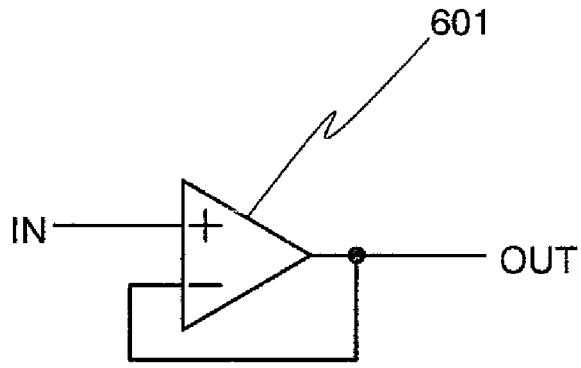
FIG. 6 Diagrams explaining a function of compensating temperature of the invention.
Figure 6:
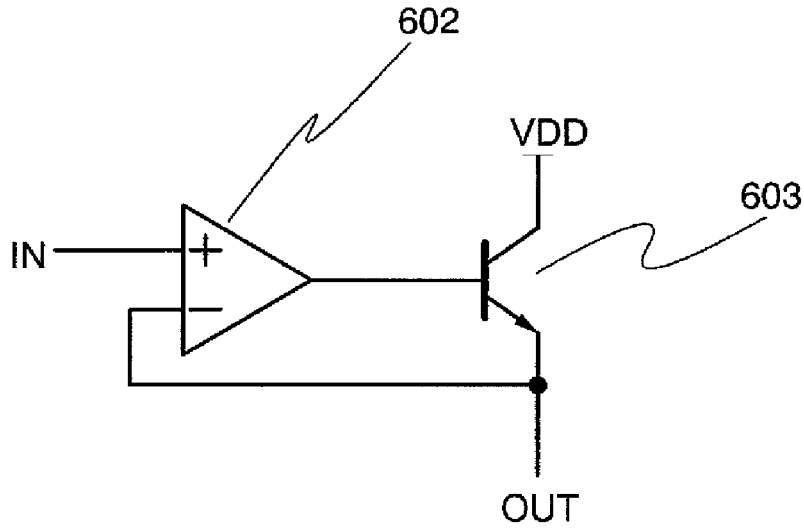
Figure 7:
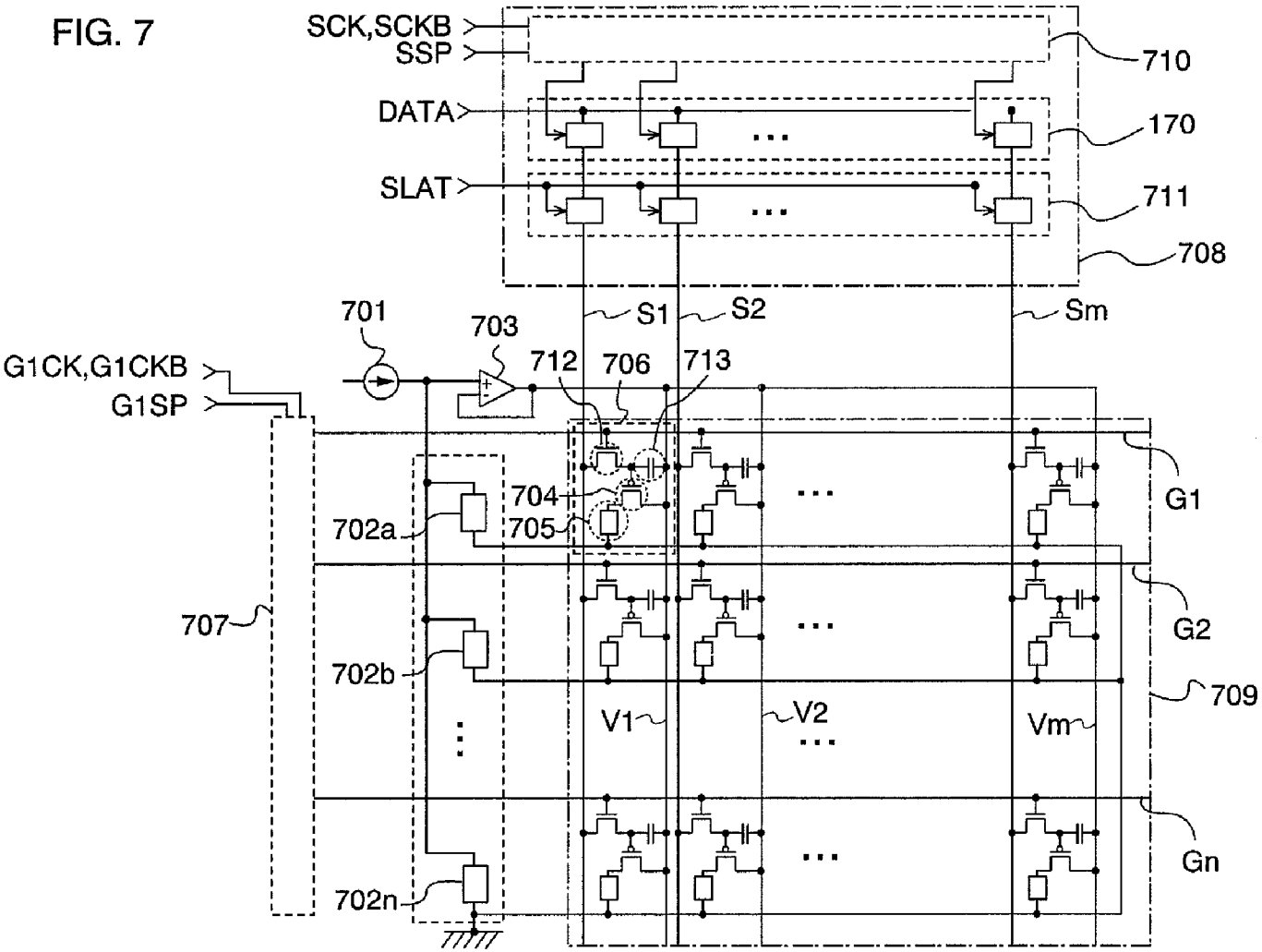
FIG. 7 A diagram explaining a display device of the invention.
Figure 8:
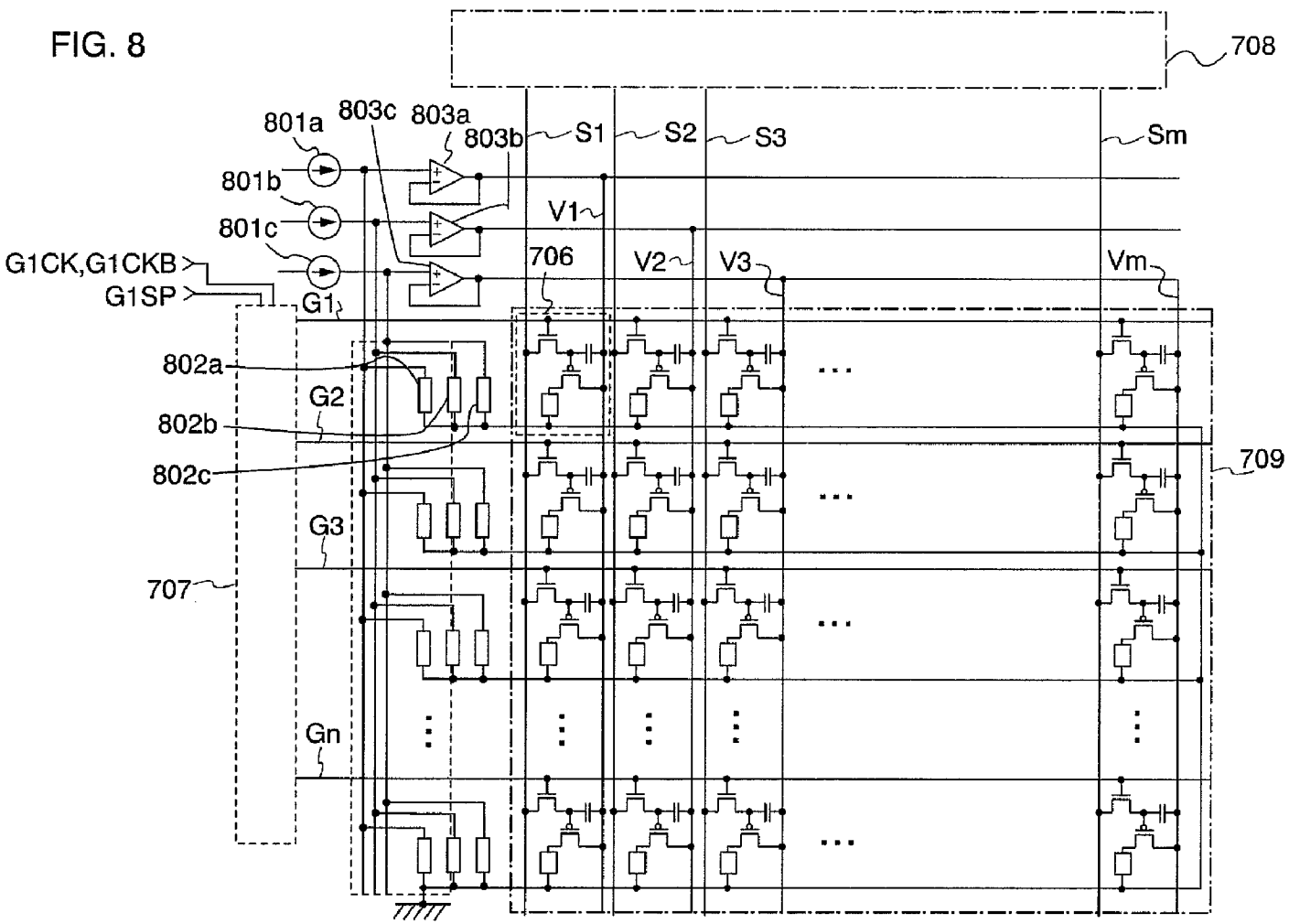
FIG. 8 A diagram explaining a display device of the invention.
Figure 9:
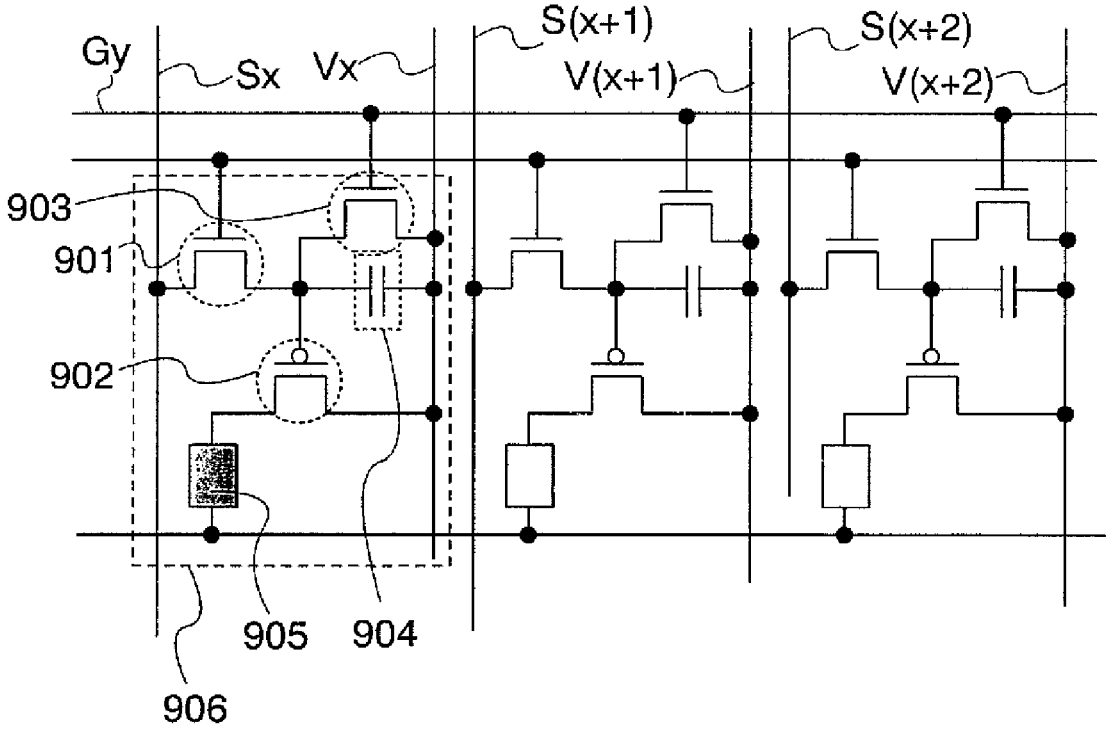
FIG. 9 A diagram explaining a pixel structure to which the invention can be applied.
Figure 10:
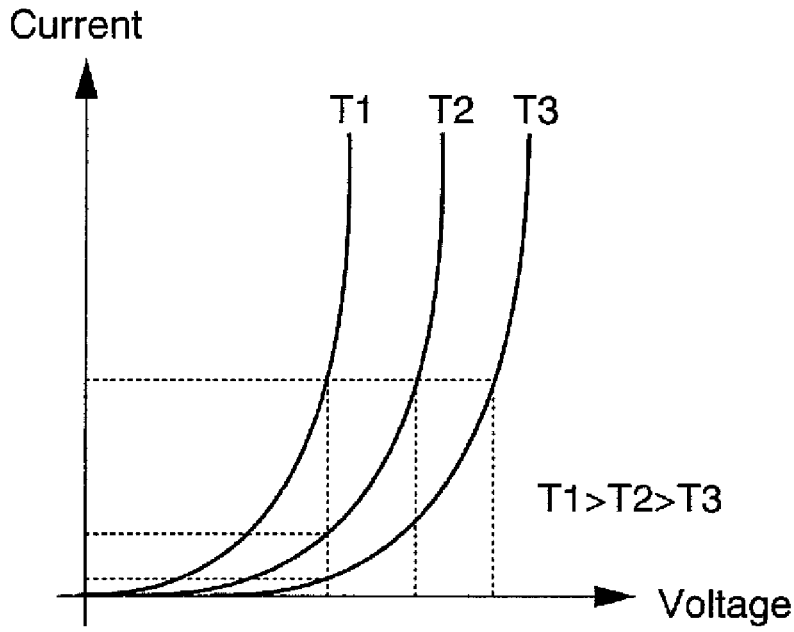
FIG. 10 Diagrams explaining voltage-current characteristics due to deterioration with time and temperature dependence of a light-emitting element.
Figure 10:
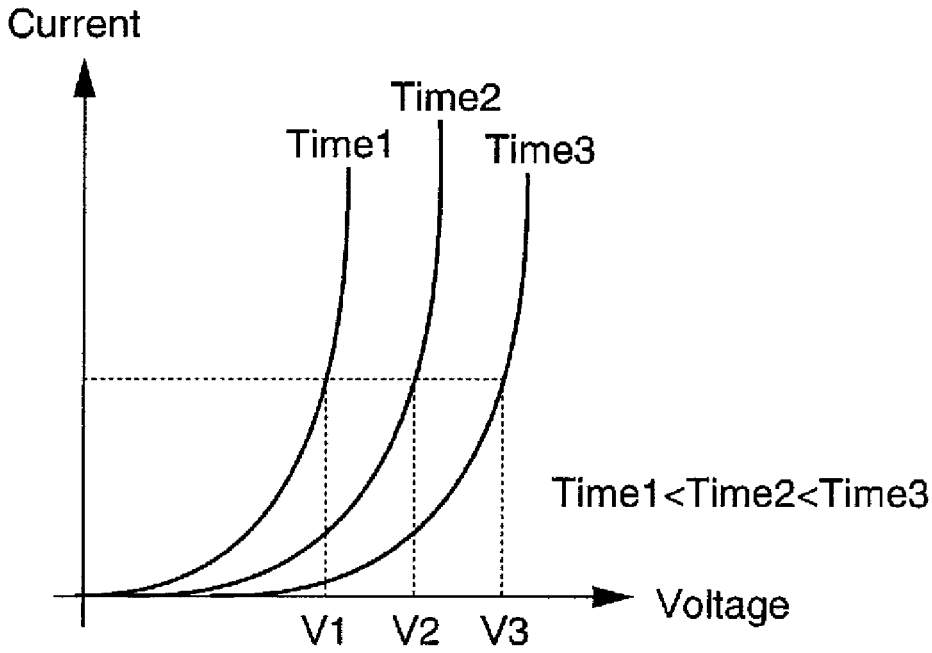
Figure 11:
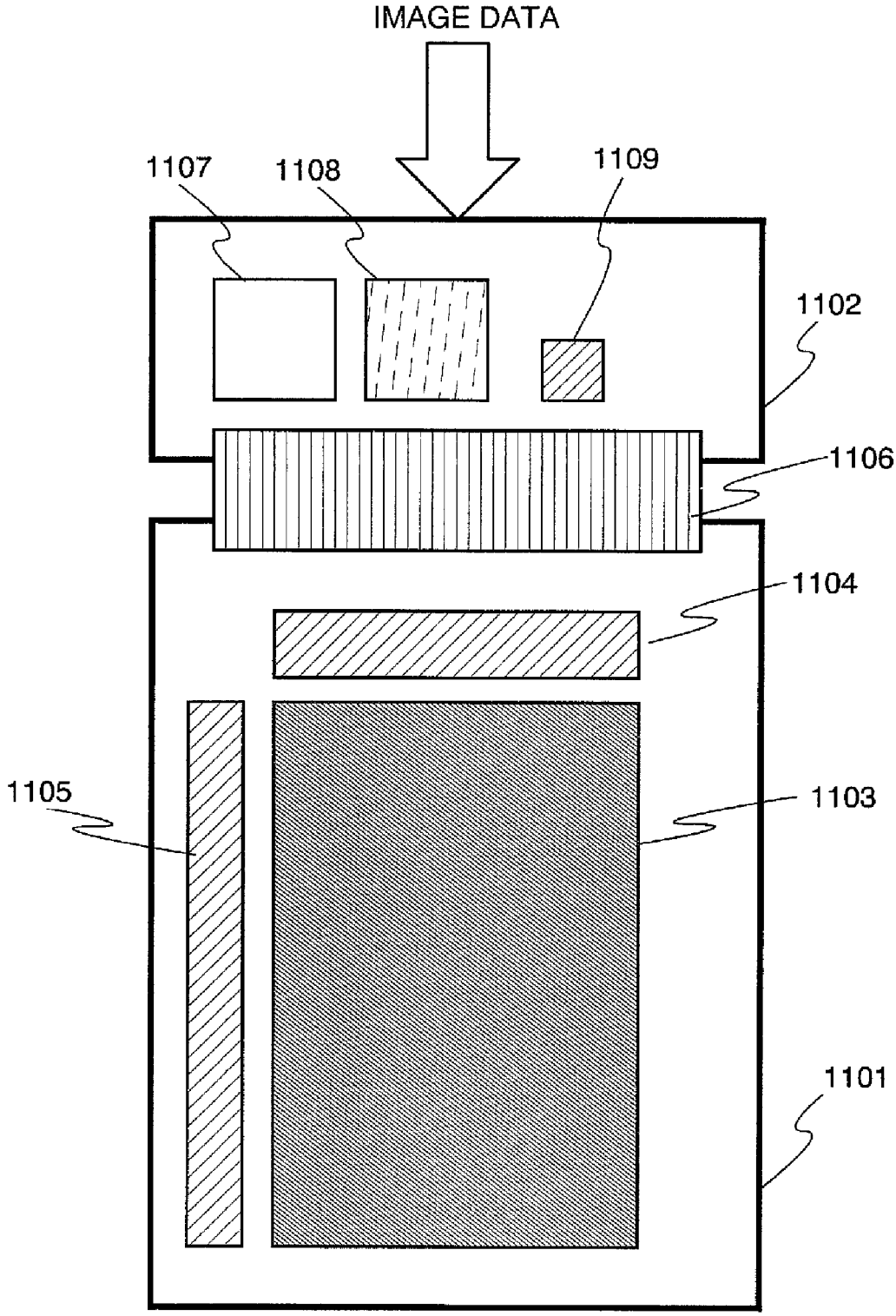
FIG. 11 A view explaining a structure of a display device of the invention.
Figure 12:
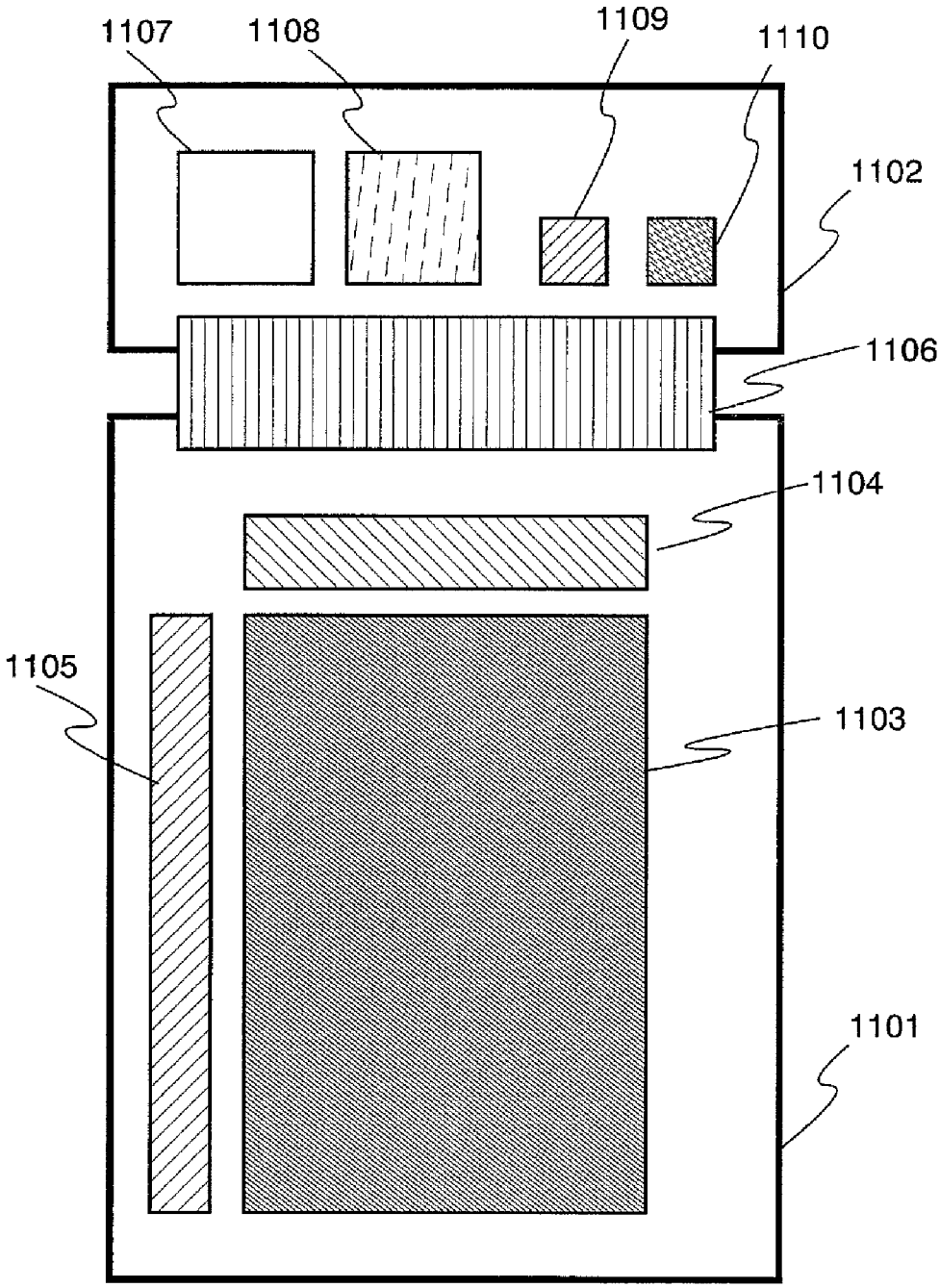
FIG. 12 A view explaining a structure of a display device of the invention.
Figure 13:
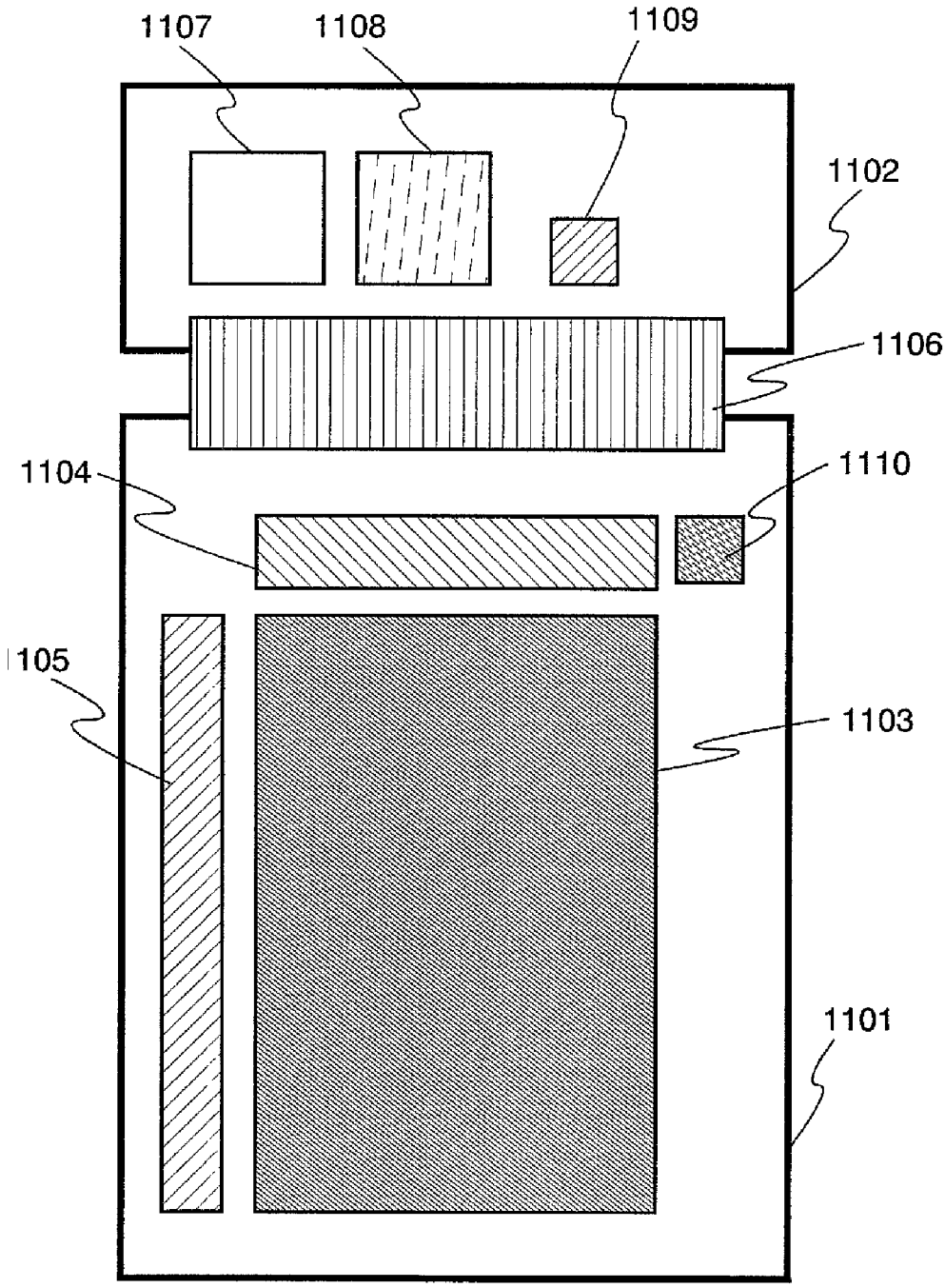
FIG. 13 A view explaining a structure of a display device of the invention.
Figure 14:
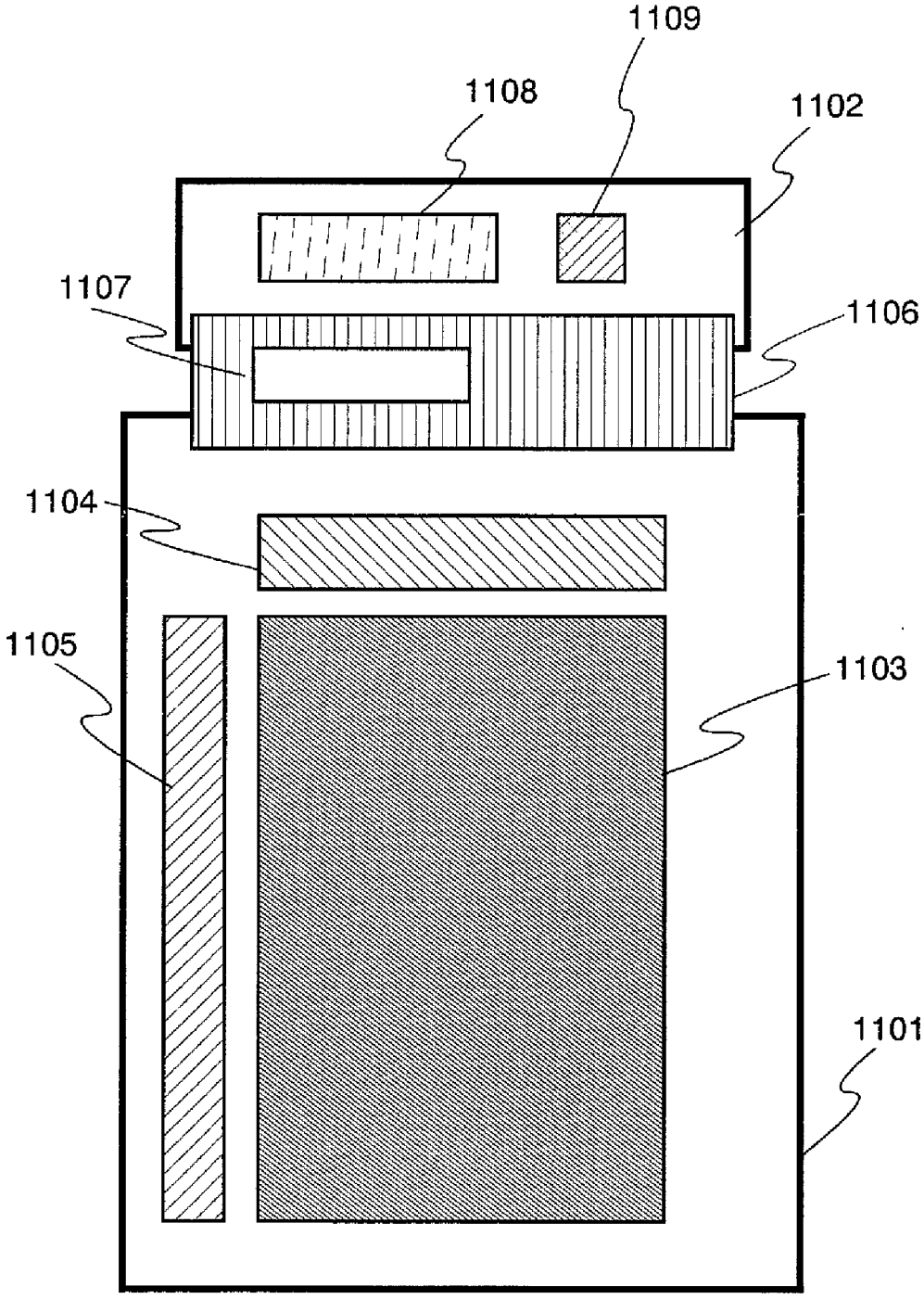
FIG. 14 A view explaining a structure of a display device of the invention.
Figure 15:
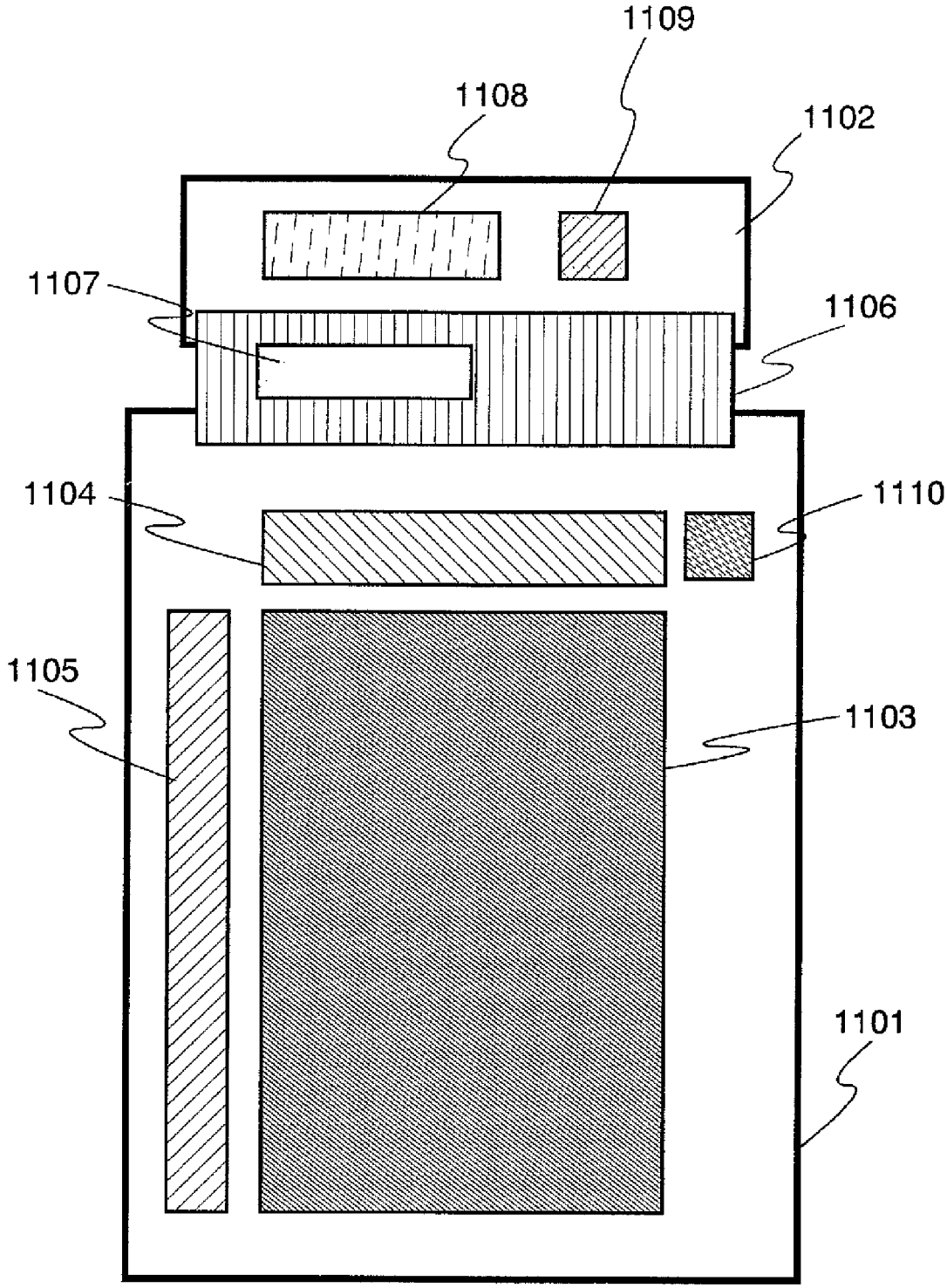
FIG. 15 A view explaining a structure of a display device of the invention.
Figure 16:
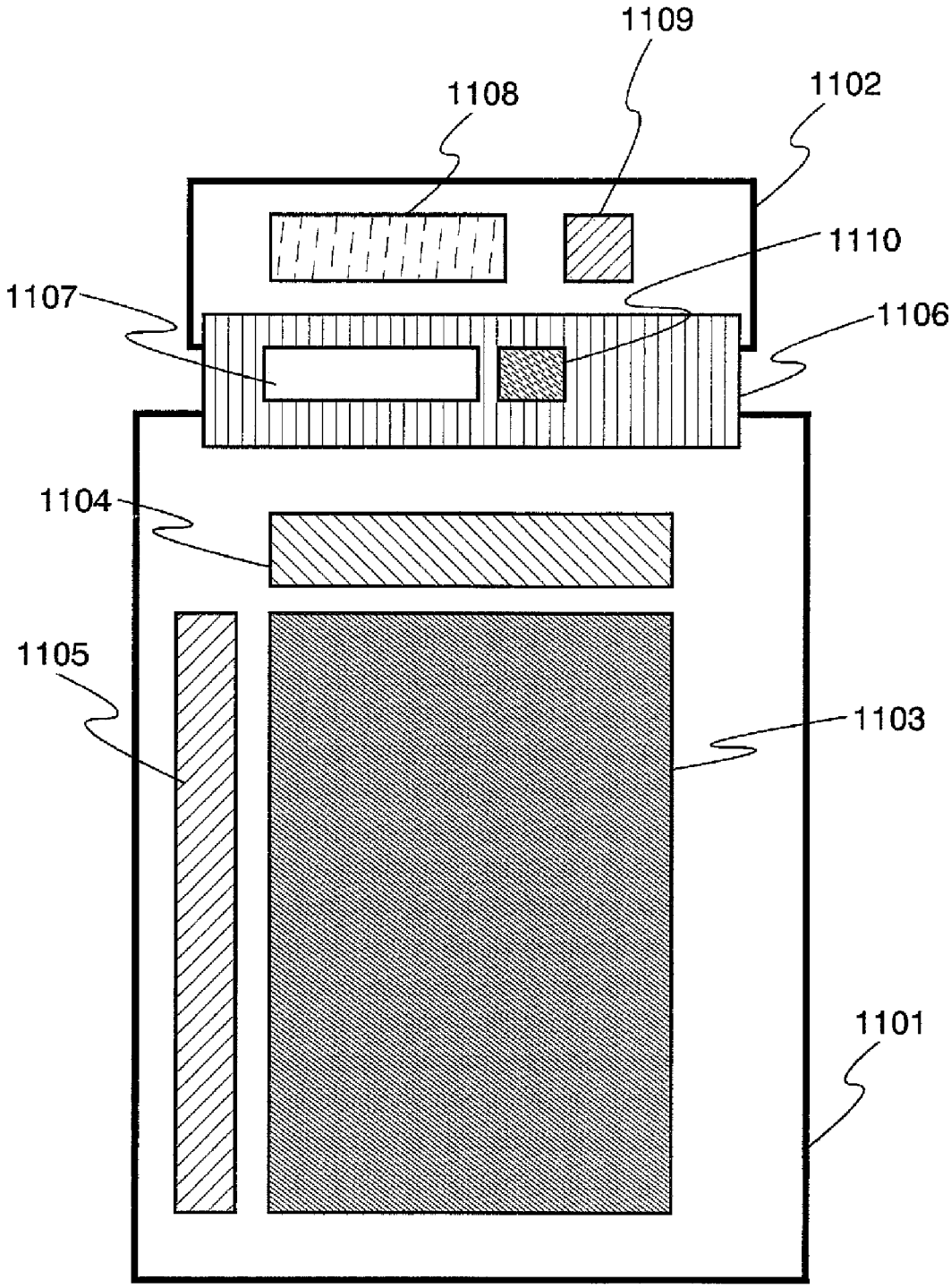
FIG. 16 A view explaining a structure of a display device of the invention.
Figure 17:
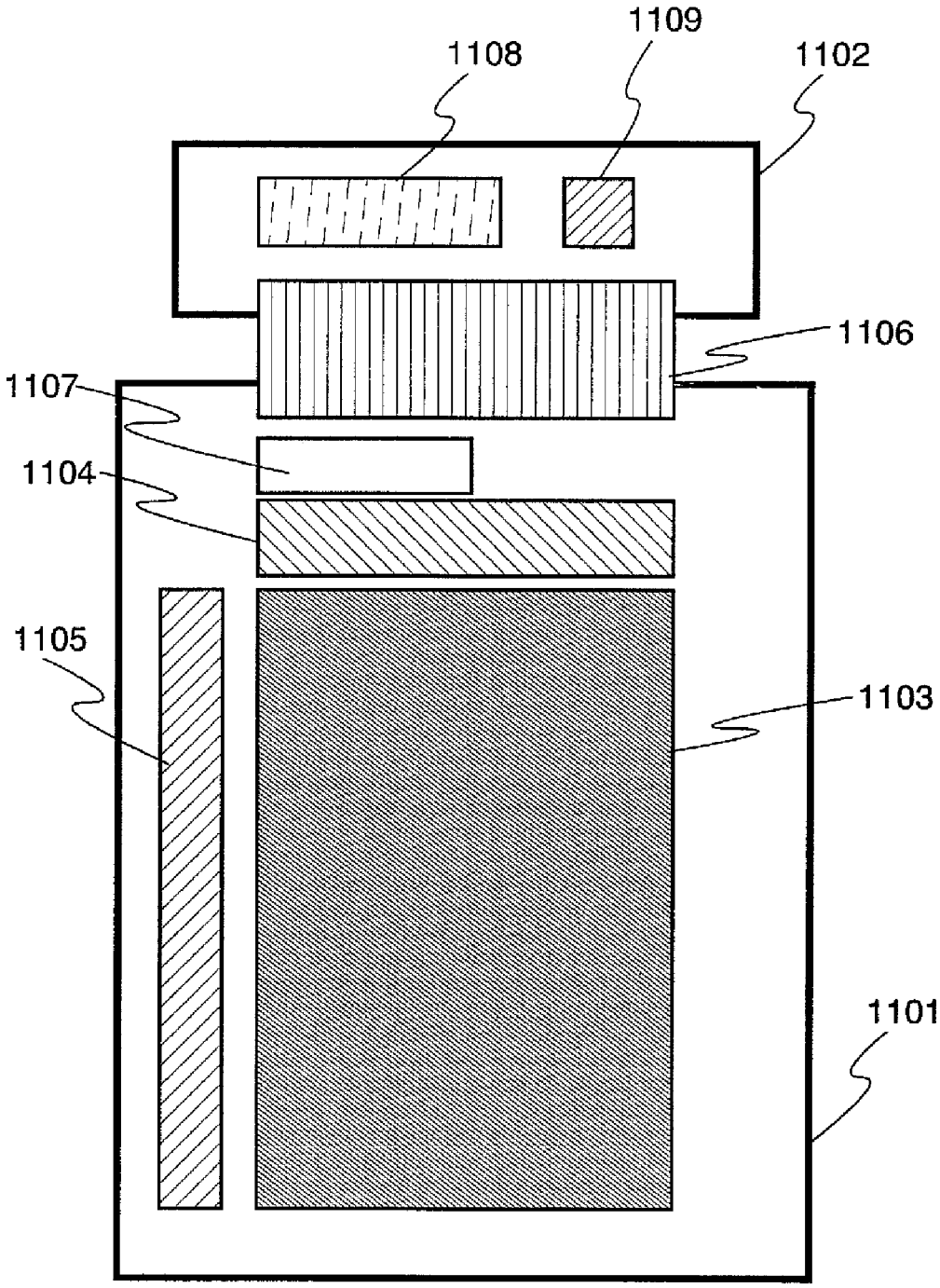
FIG. 17 A view explaining a structure of a display device of the invention.
Figure 18:
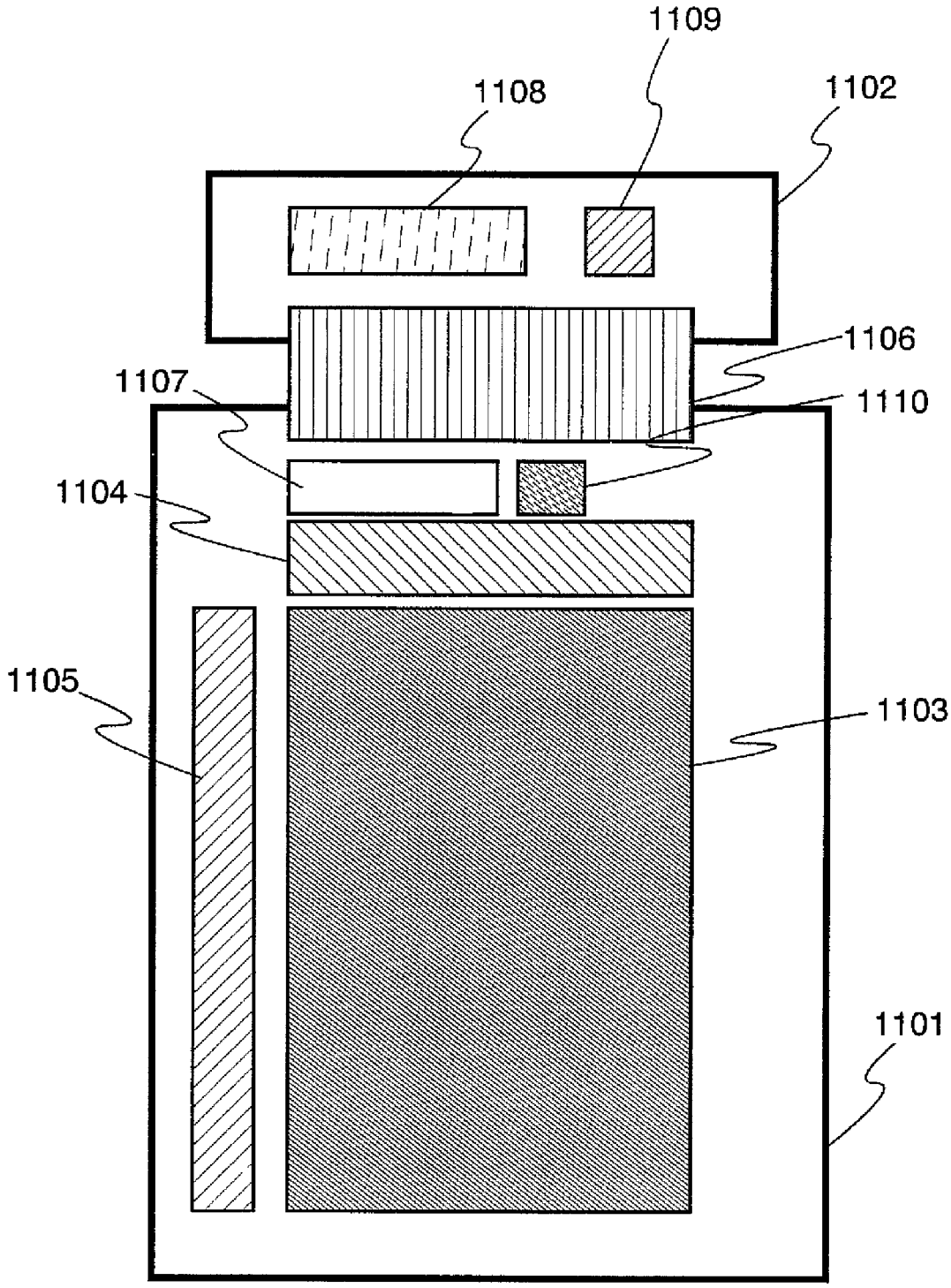
FIG. 18 A view explaining a structure of a display device of the invention.
Figure 19:
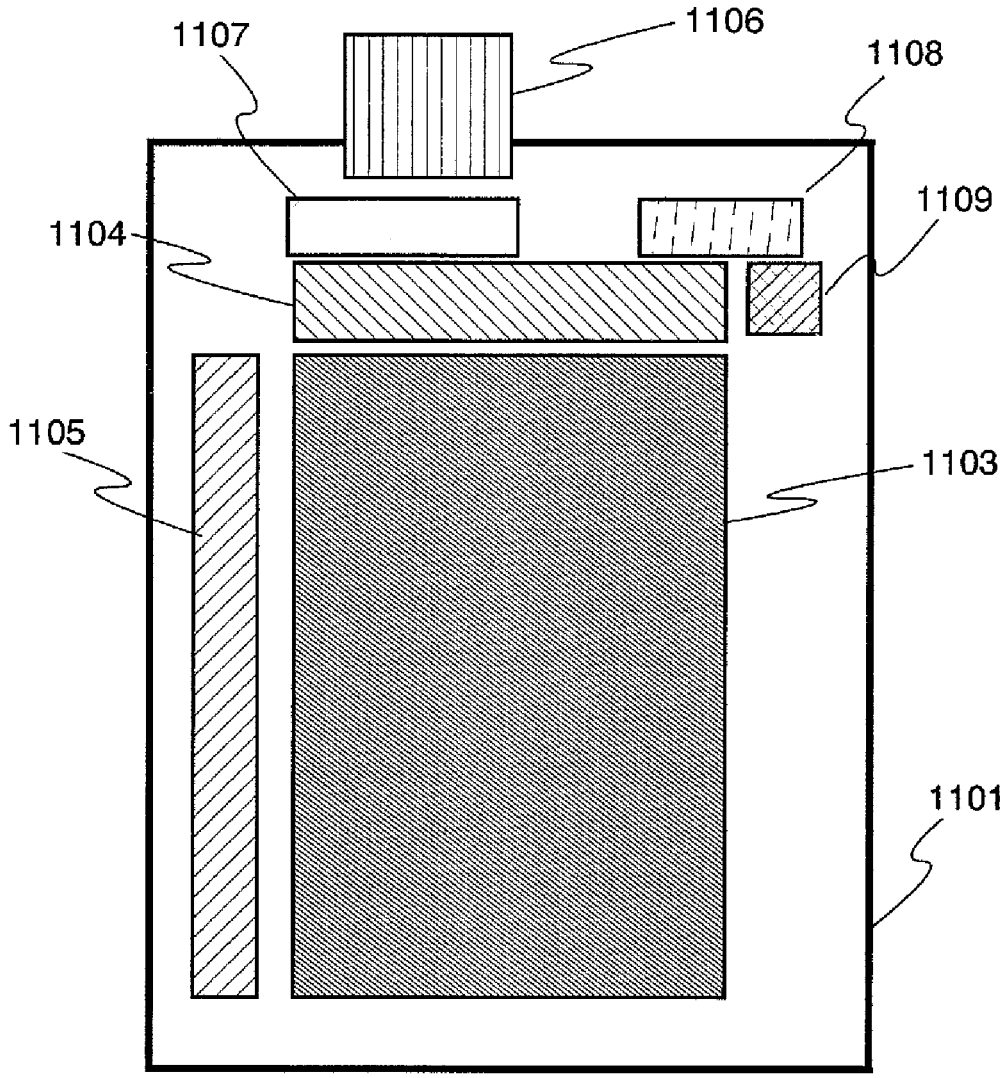
FIG. 19 A view explaining a structure of a display device of the invention.
Figure 20:
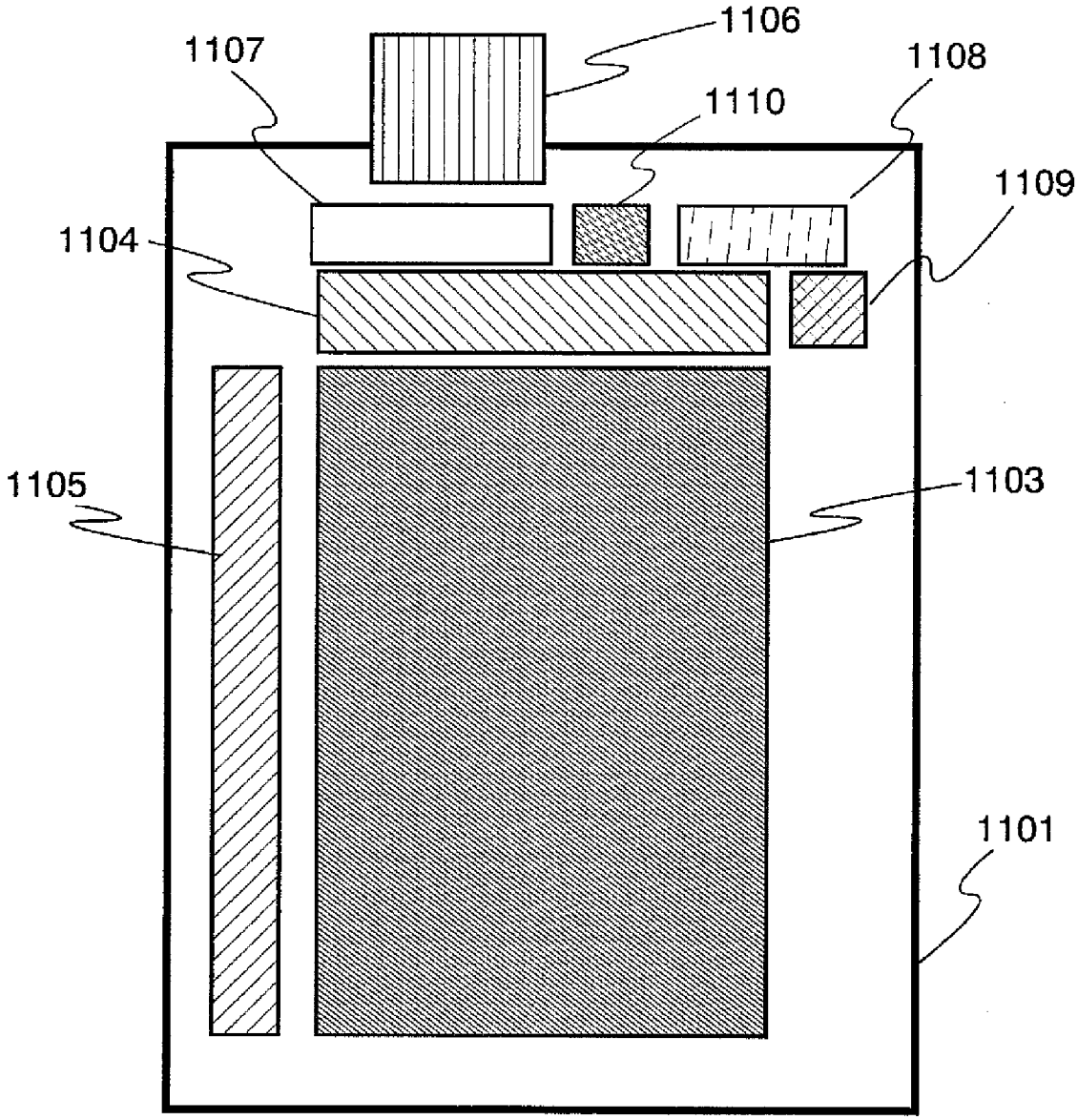
FIG. 20 A view explaining a structure of a display device of the invention.
Figure 21:
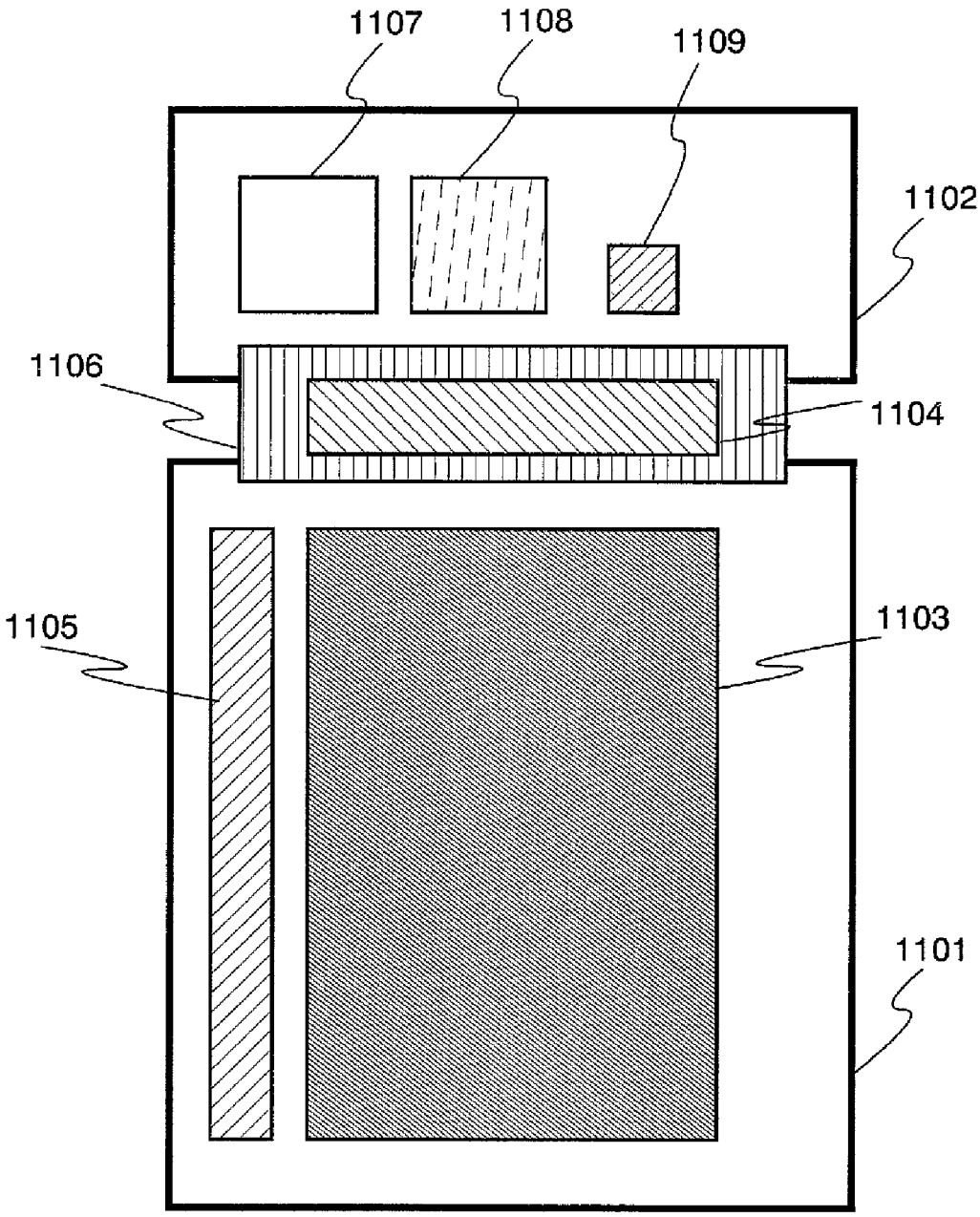
FIG. 21 A view explaining a structure of a display device of the invention.
Figure 22:
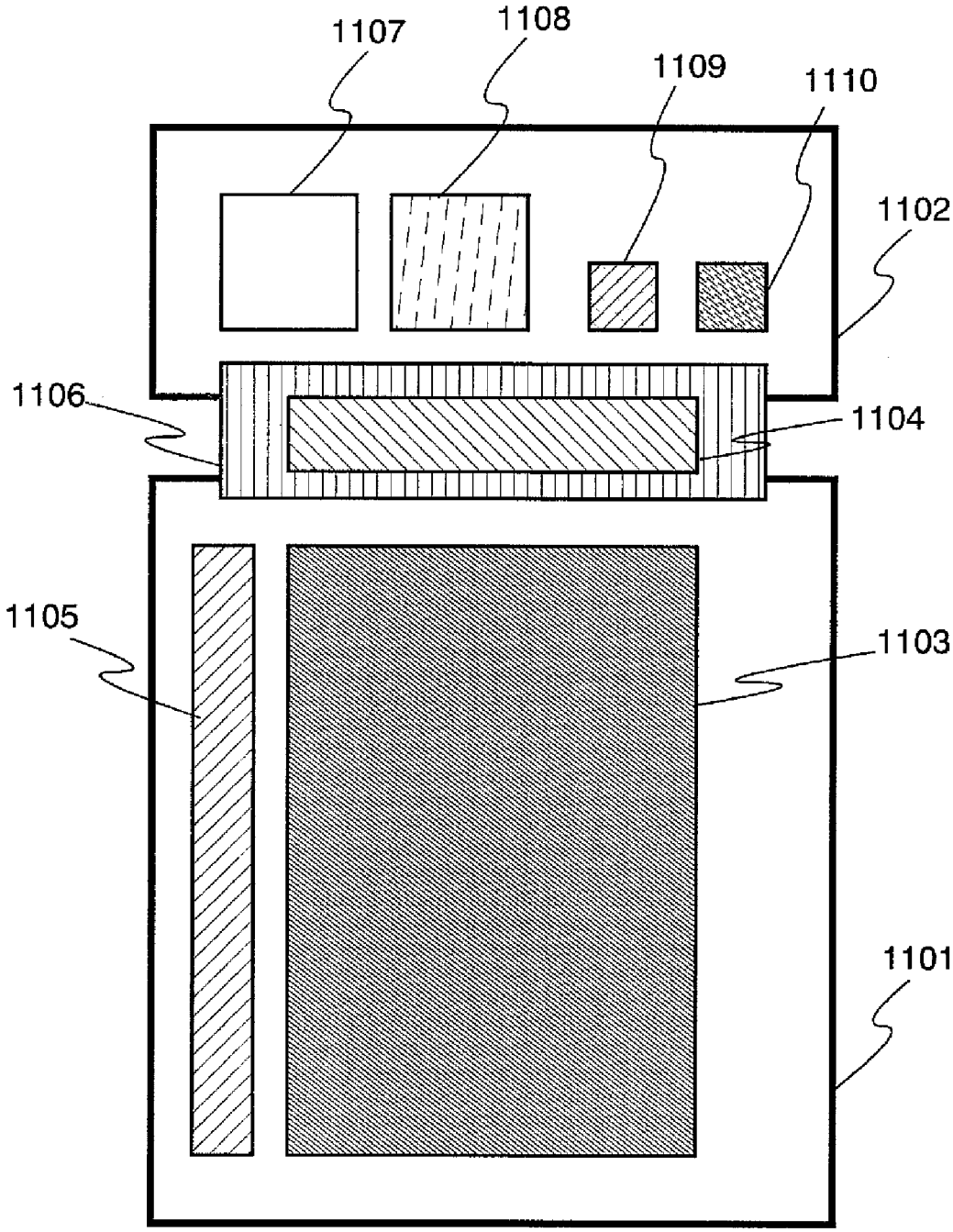
FIG. 22 A view explaining a structure of a display device of the invention.
Figure 23:
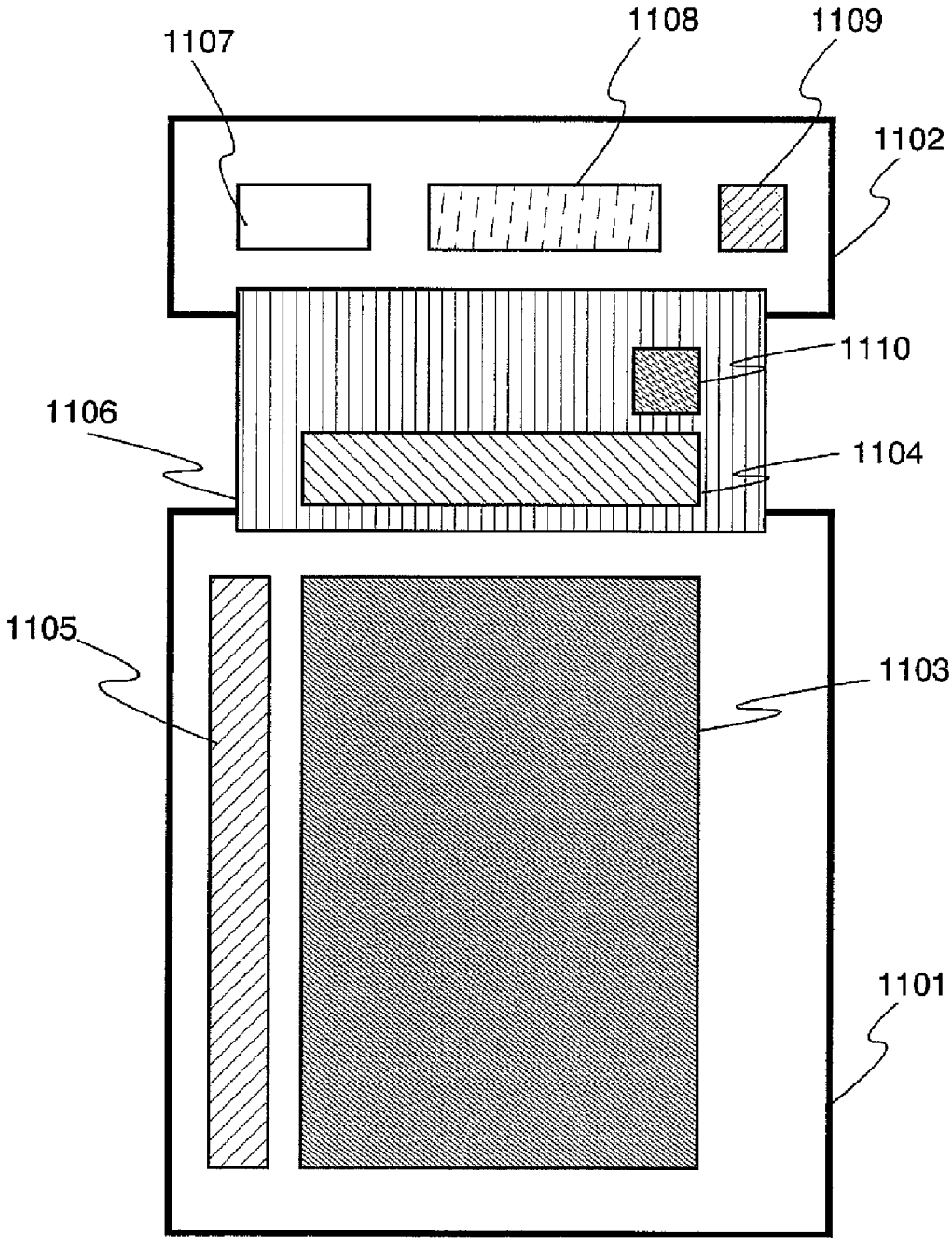
FIG. 23 A view explaining a structure of a display device of the invention.
Figure 24:
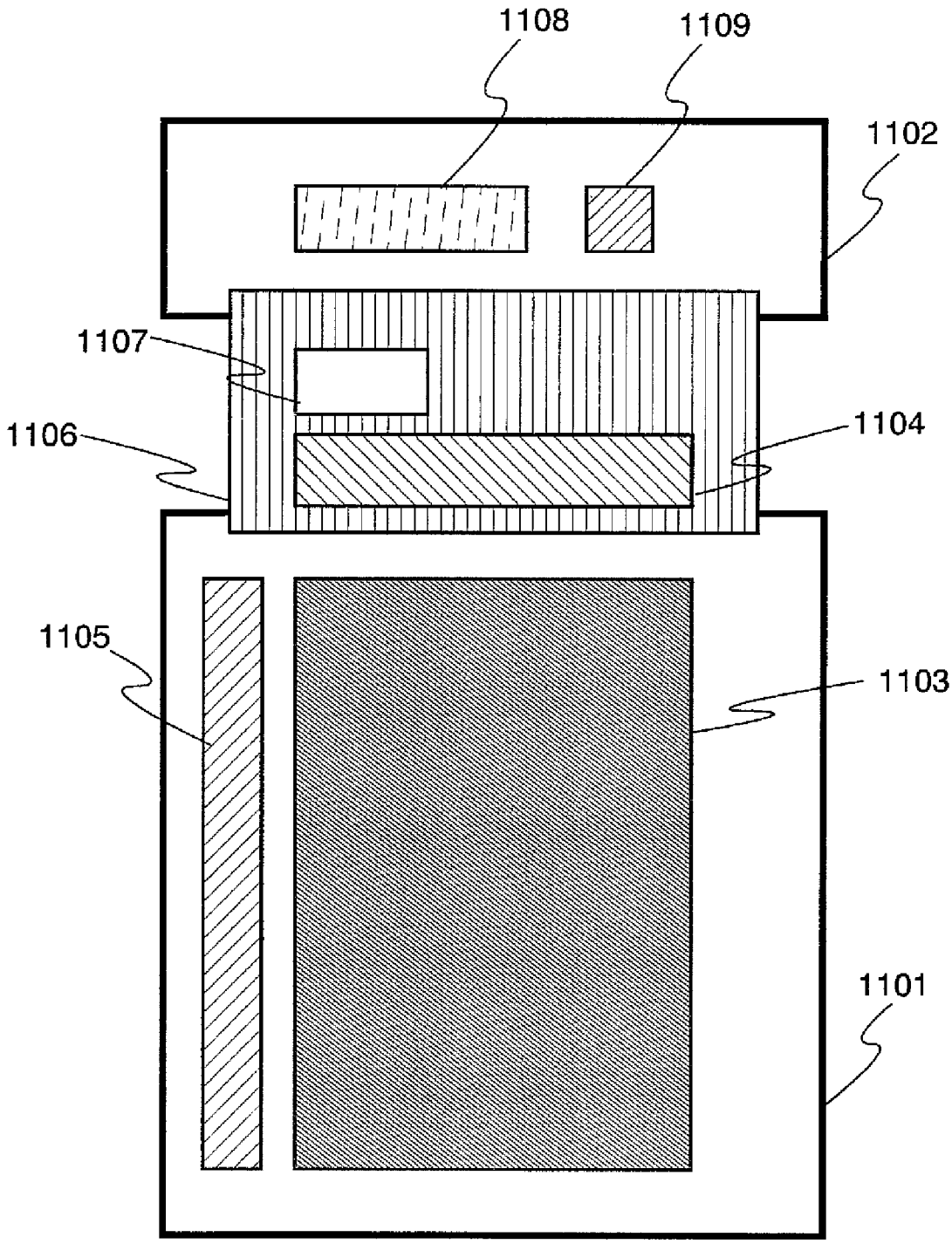
FIG. 24 A view explaining a structure of a display device of the invention.
Figure 25:
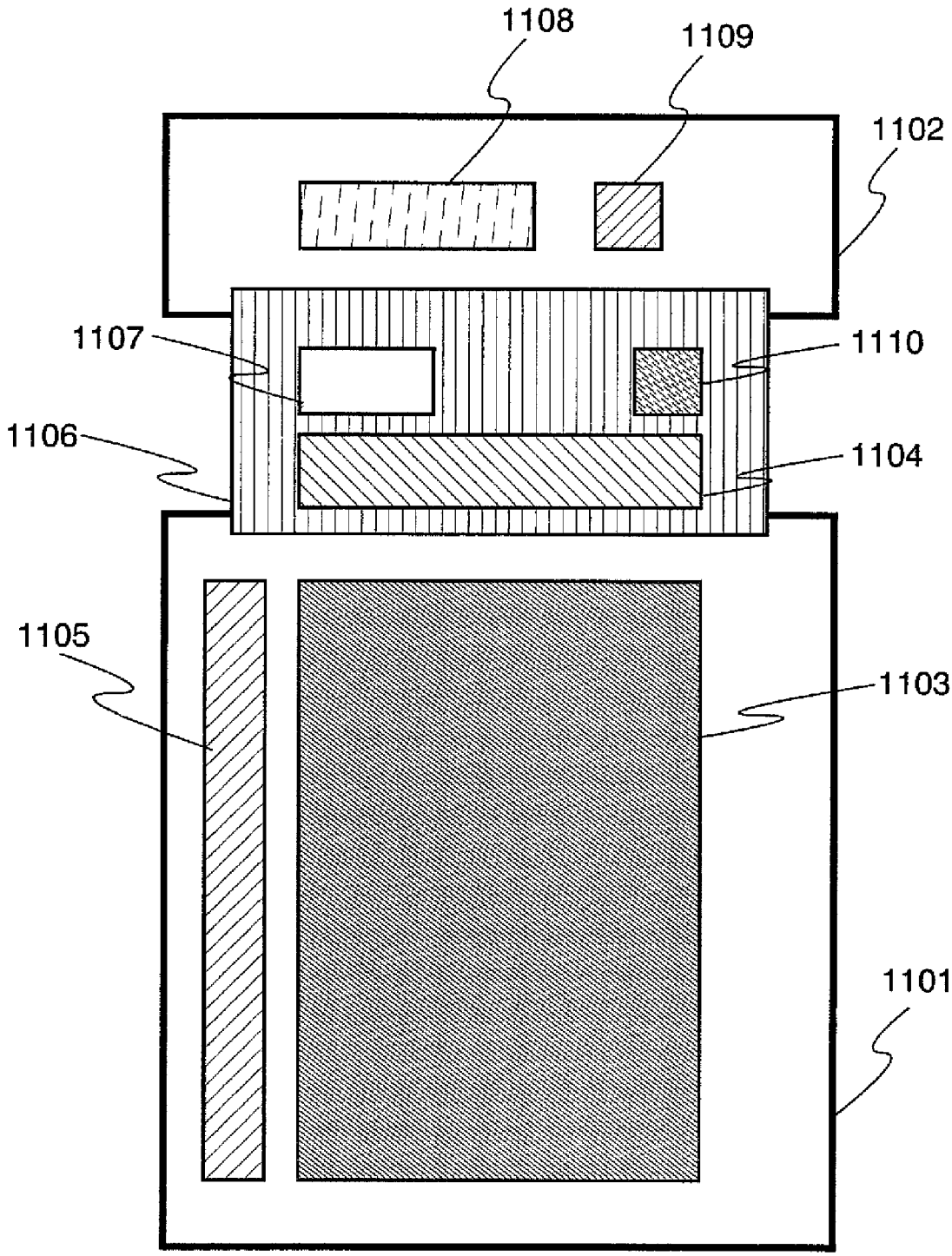
FIG. 25 A view explaining a structure of a display device of the invention.
Figure 26:
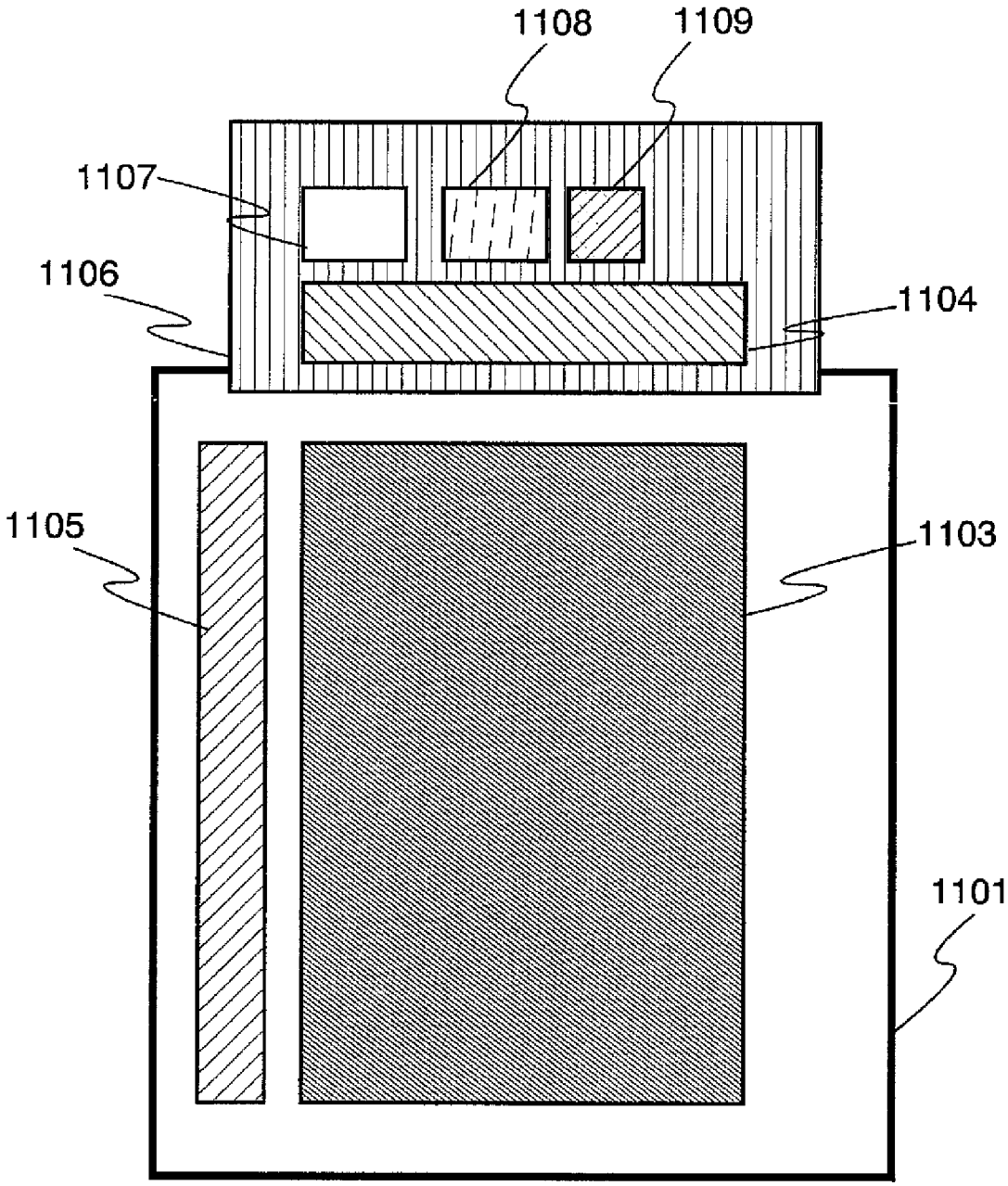
FIG. 26 A view explaining a structure of a display device of the invention.
Figure 27:
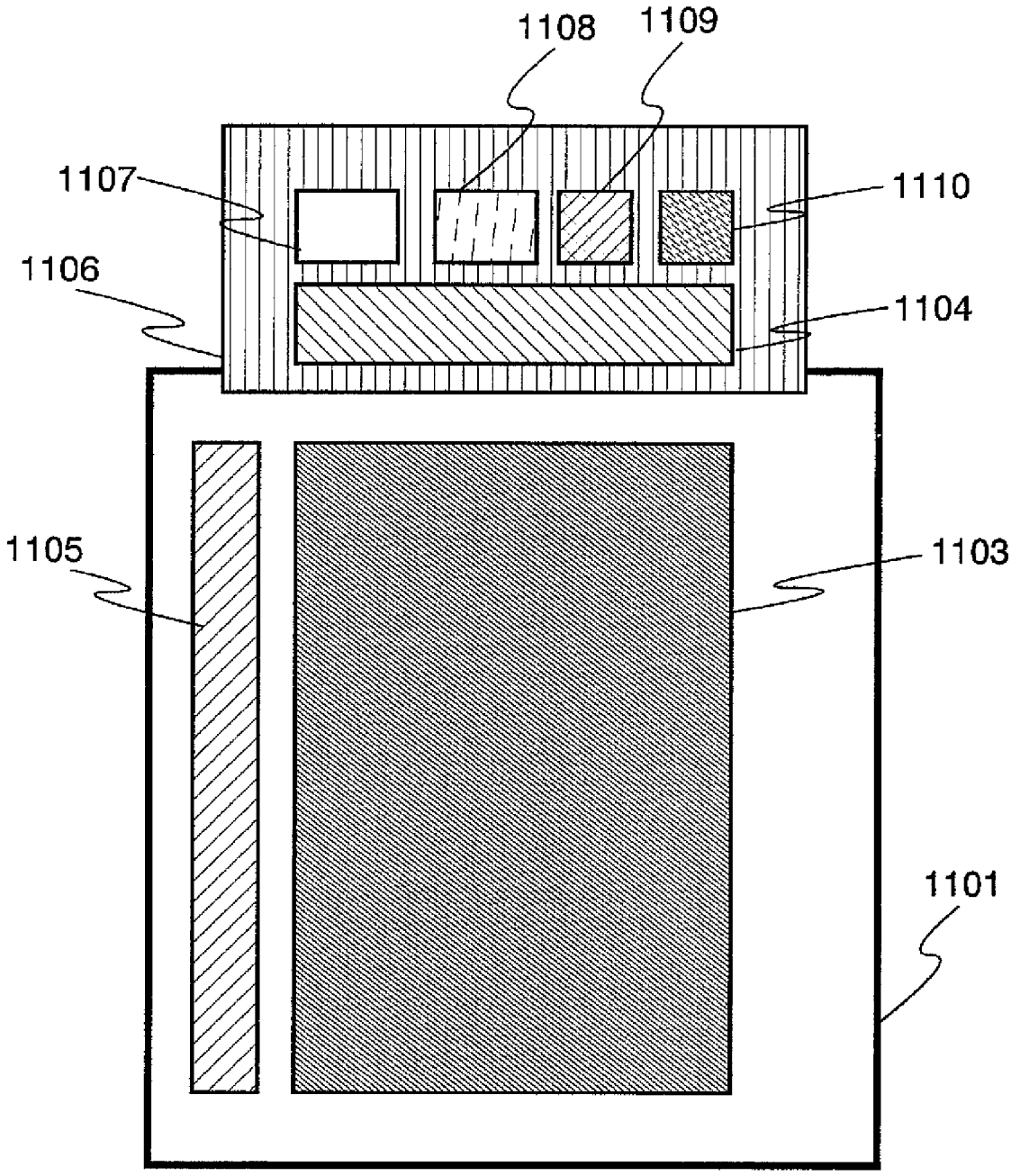
FIG. 27 A view explaining a structure of a display device of the invention.
Figure 28:
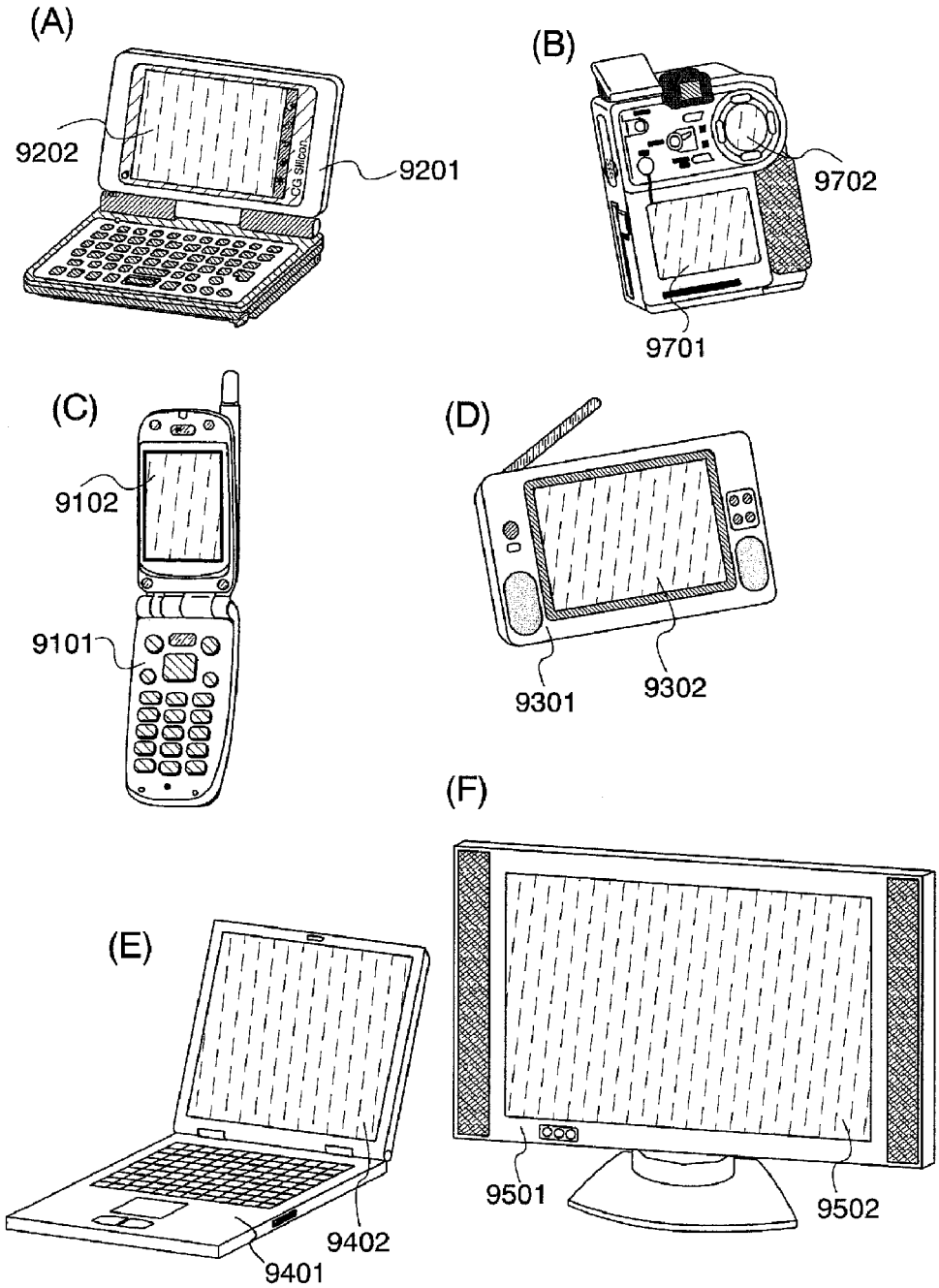
FIG. 28 Views explaining electronic appliances provided with a display device of the invention.
Figure 29:
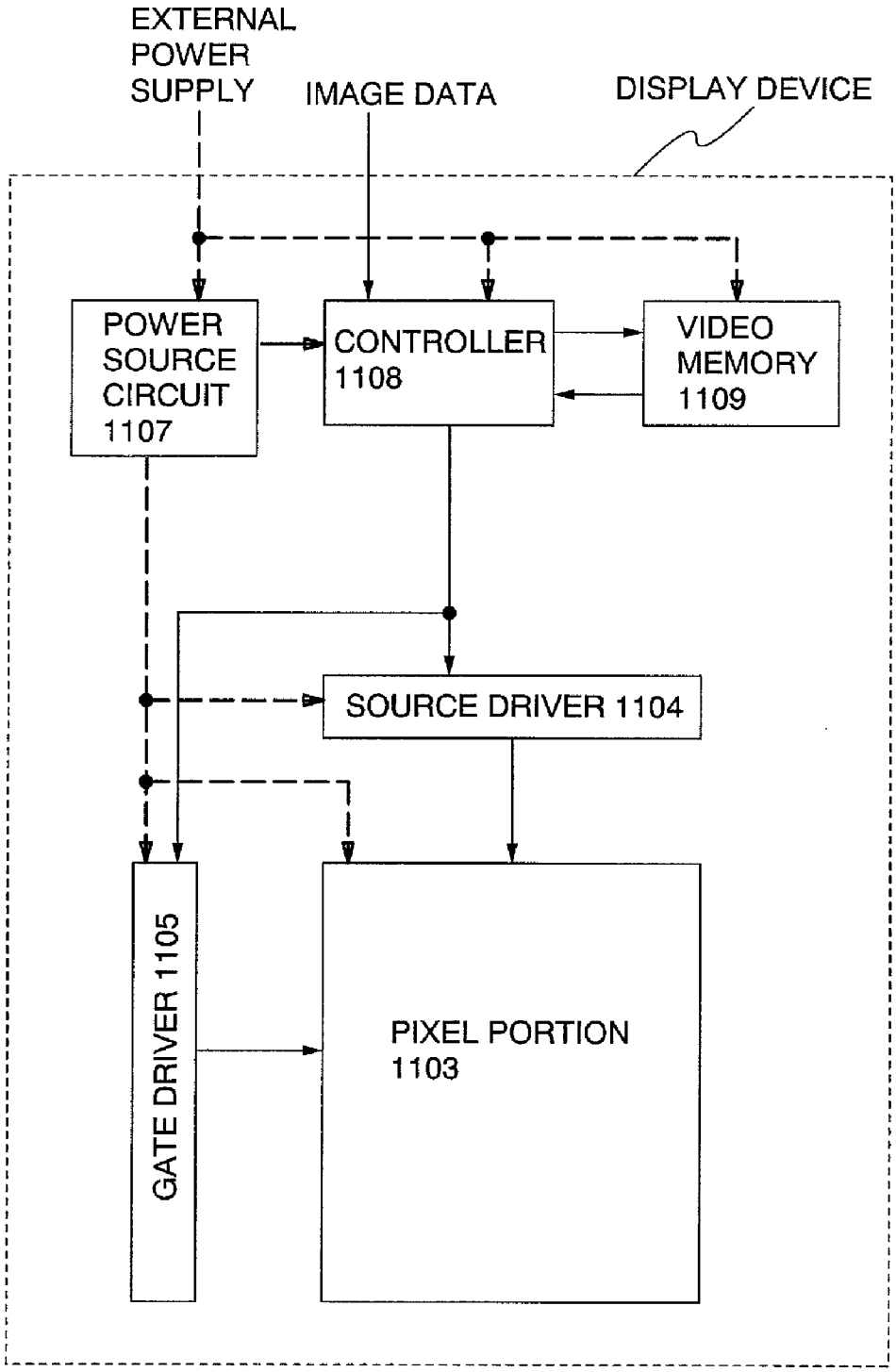
FIG. 29 A view explaining a structure of a display device of the invention.
Figure 30:
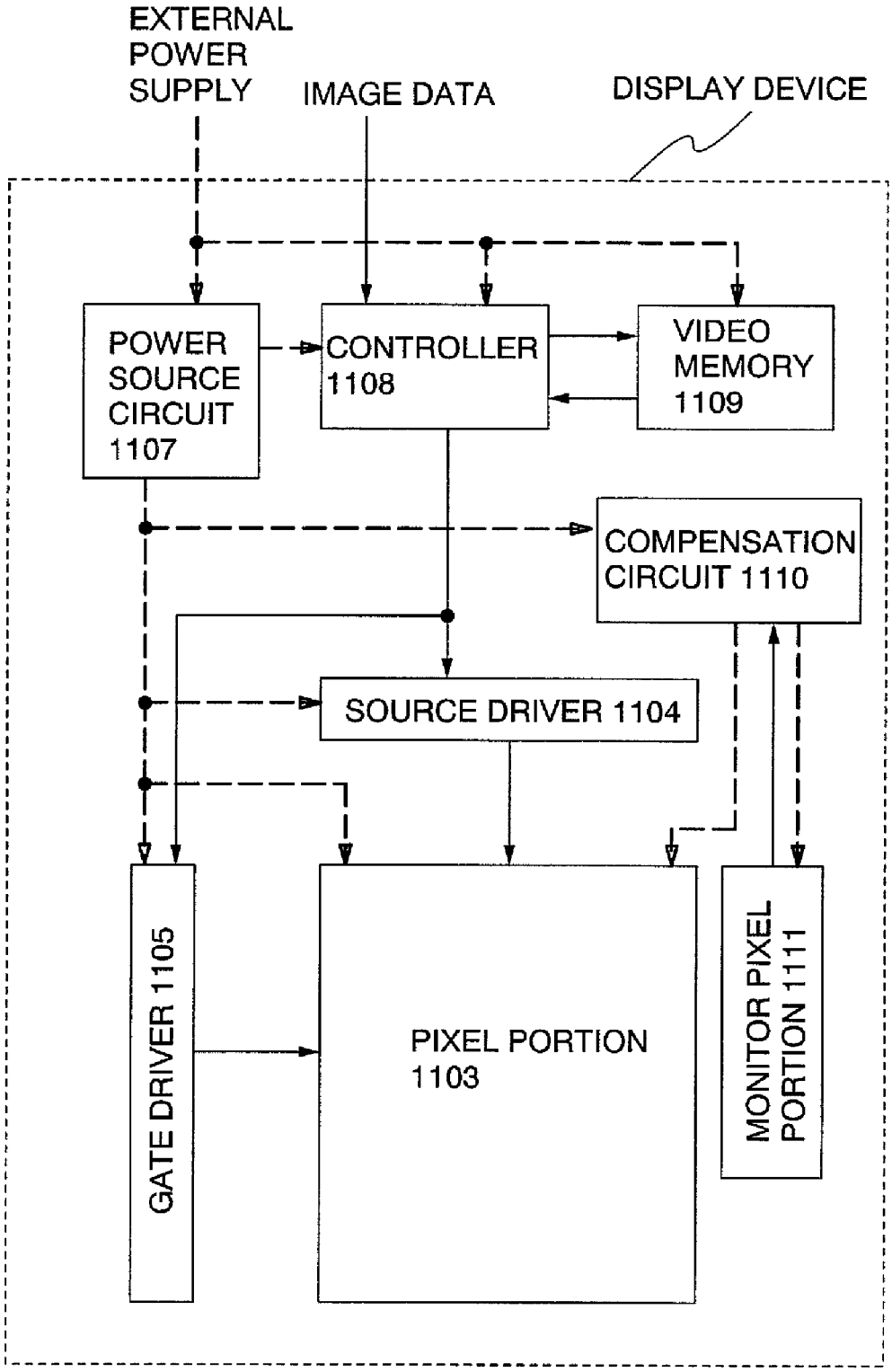
FIG. 30 A view explaining a structure of a display device of the invention.

101 current source
102 monitor element
103 buffer amplifier
104 driving TFT
105 light-emitting element
106 pixel
107 gate driver
108 source driver
109 pixel portion
110 cathode
111 anode
170 latch circuit
201 line
301 line
401 line
402 line
403 line
501 current source
502 monitor element
503 voltage follower circuit
504 driving transistor
505 light-emitting element
506 capacitor
507 switch
508 switch
509 anode
601 operational amplifier
602 operational amplifier
603 transistor
701 basic current source
703 voltage follower circuit
704 driving transistor
705 light-emitting element
706 pixel
707 gate driver
708 source driver
709 pixel portion
710 pulse output circuit
711 latch circuit
712 switching transistor
713 storage capacitor
901 switching transistor
902 driving transistor
903 erasing transistor
904 capacitor
905 light-emitting element
906 pixel
1101 display substrate (first substrate)
1102 circuit substrate (second substrate)
1103 pixel portion
1104 source driver
1105 gate driver
1106 connecting wire
1107 power source circuit
1108 controller
1109 video memory
1110 compensation circuit
1111 monitor pixel
2206 connecting wire
702*a* monitor element
801*a* basic current source
801*b* basic current source
801*c* basic current source
802*a* monitor element
802*b* monitor element
802*c* monitor element
803*a* voltage follower circuit
803*b* voltage follower circuit
803*c* voltage follower circuit
9101 main body
9102 display portion
9201 main body
9202 display portion
9301 main body
9302 display portion
9401 main body

9402 display portion
9501 main body
9502 display portion
9701 display portion

The invention claimed is:

1. An electronic appliance comprising a monitor element, a current source for supplying a current to the monitor element, an operational amplifier, a first transistor for amplifying an output of the operational amplifier, a light-emitting element, and a second transistor for driving the light-emitting element, wherein a buffer amplifier is constituted by connecting an output terminal of the operational amplifier to a base of the first transistor, connecting a first terminal of the first transistor to a positive power source, and connecting a second terminal of the first transistor to an inverted input terminal of the operational amplifier, and wherein one electrode of the monitor element and the light-emitting element is connected to a constant potential power source, the other electrode of the monitor element is connected to the buffer amplifier, a potential of the other electrode of the monitor element is set to be the same potential as a potential outputted through an amplifier, and the outputted potential is applied to the other electrode of the light-emitting element through the second transistor.

2. The electronic appliance according to claim 1, wherein the electronic appliance is at least one selected from a portable information terminal, a camera, a computer, and a television.

3. An electronic appliance comprising a monitor element, a current source for supplying a current to the monitor element, a capacitor for holding an interpolar voltage of the monitor element, a first switch for switching an on state or an off state of a connection of the capacitor and the current source, a second switch for switching an on state or an off state of a connection of the current source and the monitor element, an operational amplifier, a first transistor for amplifying an output of the operational amplifier, a light-emitting element, and a second transistor for driving the light-emitting element, wherein a buffer amplifier is constituted by connecting an output terminal of the operational amplifier to a base of the first transistor, connecting a first terminal of the first transistor to a positive power source, and connecting a second terminal of the first transistor to an inverted input terminal of the operational amplifier, and wherein one electrode of the monitor element and the light-emitting element is connected to a constant potential power source, when the first switch and the second switch are in an on state, the other electrode of the monitor element is connected to the buffer amplifier, a potential of the other electrode of the monitor element is set to be the same potential as a potential outputted through an amplifier, and the outputted potential is applied to the other electrode of the light-emitting element through the second transistor, and when the first switch and the second switch are in an off state, a potential of the other electrode of the monitor element at the moment when the first switch and the second switch are in an off state is held by the capacitor, the other potential of the monitor element held by the capacitor is applied to the buffer amplifier, a potential of the other electrode of the monitor element is set to be the same as a potential outputted through the amplifier, and the outputted potential is applied to the other electrode of the light-emitting element through the second transistor.

4. The electronic appliance according to claim 3, wherein the electronic appliance is at least one selected from a portable information terminal, a camera, a computer, and a television.

5. A driving method of an electronic appliance having a monitor element, a current source for supplying a current to the monitor element, an operational amplifier, a first transistor for amplifying an output of the operational amplifier, a light-emitting element, and a second transistor for driving the light-emitting element and constituting a buffer amplifier by connecting an output terminal of the operational amplifier to a base of the first transistor, connecting a first terminal of the first transistor to a positive power source, and connecting a second terminal of the first transistor to an inverted input terminal of the operational amplifier, comprising:

connecting one electrode of the monitor element and the light-emitting element to a constant potential power source, connecting the other electrode of the monitor element to the buffer amplifier, setting a potential of the other electrode of the monitor element to be the same as a potential outputted through an amplifier, and applying the outputted potential to the other electrode of the light-emitting element through the second transistor.

6. A driving method of an electronic appliance having a monitor element, a current source for supplying a current to the monitor element, a capacitor for holding an interpolar voltage of the monitor element, a first switch for switching an on state or an off state of a connection of the capacitor and the current source, a second switch for switching an on state or an off state of a connection of the current source and the monitor element, an operational amplifier, a first transistor for amplifying an output of the operational amplifier, a light-emitting element, and a second transistor for driving the light-emitting element; and constituting a buffer amplifier by connecting an output terminal of the operational amplifier to a base of the first transistor, connecting a first terminal of the first transistor to a positive power source, and connecting a second terminal of the first transistor to an inverted input terminal of the operational amplifier, comprising:

connecting one electrode of the monitor element and the light-emitting element to a constant power source; connecting the other electrode of the monitor element to the buffer amplifier, setting a potential of the other electrode of the monitor element to be the same as the outputted potential through an amplifier, and applying the other potential of the monitor element held by the capacitor to the buffer amplifier when the first switch and the second switch are in an on state; holding the other potential of the monitor element at the moment when the first switch and the second switch are in an off state is held by the capacitor, applying the other potential of the monitor element held by the capacitor to the buffer amplifier, setting a potential of the other electrode of the monitor element to be the same as the outputted potential through the amplifier, and applying the outputted potential to the other electrode of the light-emitting element through the second transistor when the first switch and the second switch are in an off state.

* * * * *